US009702119B2

(12) United States Patent
Matsuyama et al.

(10) Patent No.: US 9,702,119 B2
(45) Date of Patent: Jul. 11, 2017

(54) HYDRAULIC EXCAVATOR

(71) Applicant: KOMATSU LTD., Tokyo (JP)

(72) Inventors: Toru Matsuyama, Naka-gun (JP); Takeshi Takaura, Minoh (JP)

(73) Assignee: KOMATSU LTD., Tokyo (JP)

( * ) Notice: Subject to any disclaimer, the term of this patent is extended or adjusted under 35 U.S.C. 154(b) by 269 days.

(21) Appl. No.: 14/410,832

(22) PCT Filed: Sep. 5, 2014

(86) PCT No.: PCT/JP2014/073486

§ 371 (c)(1),
(2) Date: Dec. 23, 2014

(87) PCT Pub. No.: WO2015/030265

PCT Pub. Date: Mar. 5, 2015

(65) Prior Publication Data

US 2016/0273193 A1 Sep. 22, 2016

(51) Int. Cl.

| | |
|---|---|
| ***E02F 9/22*** | (2006.01) |
| ***E02F 3/43*** | (2006.01) |
| ***E02F 9/26*** | (2006.01) |
| ***E02F 3/32*** | (2006.01) |

(52) U.S. Cl.

CPC ..... *E02F 9/2228* (2013.01); *E02F 3/32* (2013.01); *E02F 3/435* (2013.01); *E02F 3/437* (2013.01); *E02F 9/2207* (2013.01); *E02F 9/2267* (2013.01); *E02F 9/2285* (2013.01); *E02F 9/2292* (2013.01); *E02F 9/262* (2013.01); *E02F 9/265* (2013.01)

(58) Field of Classification Search

None

See application file for complete search history.

(56) References Cited

U.S. PATENT DOCUMENTS

| | | | | | |
|---|---|---|---|---|---|
| 4,706,932 | A | * | 11/1987 | Yoshida | F15B 13/0405 137/596.16 |
| 4,733,600 | A | * | 3/1988 | Masano | F15B 13/0422 414/701 |
| 5,289,679 | A | * | 3/1994 | Yasuda | E02F 9/2232 60/422 |
| 5,572,809 | A | * | 11/1996 | Steenwyk | B25J 9/1656 172/2 |

(Continued)

FOREIGN PATENT DOCUMENTS

| | | | |
|---|---|---|---|
| CN | 1651666 | A | 8/2005 |
| CN | 101481918 | A | 7/2009 |

(Continued)

*Primary Examiner* — Truc M Do

(74) *Attorney, Agent, or Firm* — Drinker Biddle & Reath LLP

(57) ABSTRACT

There is provided a hydraulic excavator in which the highly-accurate land leveling work is possible. A boom-lowering pilot conduit connected to a boom-lowering pilot port is provided with a boom-lowering proportional solenoid valve. When an arm dump signal for performing dump operation of an arm is included in a hydraulic pressure signal, a controller sharply increases a current value outputted to the boom-lowering proportional solenoid valve, as compared with when an arm excavation signal for performing excavation operation of the arm is included in the hydraulic pressure signal.

8 Claims, 11 Drawing Sheets

(56) References Cited

U.S. PATENT DOCUMENTS 5,835,874 A * 11/1998 Hirata ..... E02F 3/435 414/4
5,933,346 A * 8/1999 Brabec ..... E02F 3/437 340/684
5,953,838 A * 9/1999 Steenwyk ..... E02F 3/437 172/2
6,101,437 A * 8/2000 Oshina ..... E02F 3/301 37/348
6,233,511 B1 * 5/2001 Berger ..... E02F 3/432 414/699
6,371,214 B1 * 4/2002 Anwar ..... E02F 3/434 172/1
6,618,659 B1 * 9/2003 Berger ..... E02F 3/431 172/12
7,979,229 B2 * 7/2011 Otaka ..... F04B 17/05 702/98
8,244,438 B2 8/2012 Koch et al.
9,458,598 B2 * 10/2016 Takaura ..... E02F 3/437
2003/0075378 A1 * 4/2003 Sprinkle ..... F16H 61/46 180/321
2003/0147727 A1 * 8/2003 Fujishima ..... E02F 3/435 414/200
2005/0000703 A1 * 1/2005 Furuno ..... G01G 19/08 172/2
2005/0175485 A1 * 8/2005 Udagawa ..... E02F 9/2228 417/437
2007/0204604 A1 * 9/2007 Naruse ..... E02F 9/2235 60/433
2007/0227137 A1 * 10/2007 Naruse ..... E02F 9/2235 60/426
2008/0000111 A1 * 1/2008 Green ..... E02F 3/435 37/348
2012/0198831 A1 * 8/2012 Kodaka ..... E02F 3/962 60/422
2012/0310492 A1 * 12/2012 Karasawa ..... E02F 9/2253 701/50
2013/0333364 A1 * 12/2013 Carpenter ..... F15B 3/00 60/327
2015/0233086 A1 8/2015 Takaura

FOREIGN PATENT DOCUMENTS

CN 102720243 10/2012
JP H07-207697 A 8/1995
JP H09-151487 A 6/1997
JP H11-81391 A 3/1999
JP H11-350537 A 12/1999
JP 2001-032331 A 2/2001
JP 2008-216143 A 9/2008
WS WO 2014/192190 A1 12/2014

* cited by examiner

HYDRAULIC EXCAVATOR

TECHNICAL FIELD

The present invention relates to a hydraulic excavator.

BACKGROUND ART

As to conventional hydraulic excavators, Japanese Patent Laying-Open No. 7-207697 (MD 1) discloses such a configuration that an electromagnetic switching valve including an oil passage position with a throttle is provided in a conduit connected to a boom-lowering pilot port of a pilot switching valve for a boom. PTD 1 also discloses such a configuration that a pressure sensor is provided on the boom-lowering pilot port side, and a pressure signal detected by the pressure sensor is inputted to a controller.

CITATION LIST

Patent Document

PTD 1: Japanese Patent Laying-Open No. 7-207697

SUMMARY OF INVENTION

Technical Problem

There has been devised a work vehicle in which the design topographic information is obtained from outside, a position of a work implement is detected, and the work implement is automatically controlled based on the design topographic information and the detected position of the work implement. In the case of automatically controlling the work implement in a land leveling work with a hydraulic excavator, control for raising a boom automatically and forcibly is executed when it is expected that a cutting edge of a bucket will become lower than a design topography, in order to avoid deeper excavation than the design topography.

The cutting edge of the bucket follows the arc-shaped path with a tip of the boom being the center, and thus, the cutting edge of the bucket may move away from the design topography if a boom-lowering operation is not performed during a scrape-off work for forming a flat surface. Therefore, it is preferable that an operator operating the hydraulic excavator continues to operate a control lever toward the boom-lowering side during the scrape-off work. When the operator continues to operate the control lever toward the boom-lowering side as described above, minute vibrations (chattering) occur in the control lever, which brings a sense of discomfort to the operator gripping the control lever.

Thus, the applicant of the present application has already filed the invention of gently increasing from zero a current value outputted to a boom-lowering proportional solenoid valve (PCT/JP2013/082825). This invention makes it possible to suppress fluctuations in an amount of oil present between the control lever and the boom-lowering proportional solenoid valve. Therefore, fluctuations in pressure of the oil can be suppressed, and thus, the occurrence of minute vibrations in the control lever can be suppressed.

An arm of the work implement can be operated both in an excavation direction in which the arm comes closer to a work vehicle main body and in a dump direction in which the arm moves away from the work vehicle main body. When the current value outputted to the boom-lowering proportional solenoid valve is increased gently from zero as described above in the case of performing the scrape-off work while actuating the arm in the dump direction, the cutting edge of the bucket by automatic control is not stable and hunting may occur.

An object of the present invention is to provide a hydraulic excavator in which such hunting is prevented and the highly-accurate land leveling work is possible.

Solution to Problem

A hydraulic excavator according to the present invention includes: a work implement; a pilot switching valve for a boom; a boom-lowering pilot conduit; a boom-lowering proportional solenoid valve; an operation member; and a controller. The work implement includes a boom and an arm attached to the boom. The pilot switching valve for the boom includes a boom-lowering pilot port and controls operation of the boom. The boom-lowering pilot conduit is connected to the boom-lowering pilot port. The boom-lowering proportional solenoid valve is provided in the boom-lowering pilot conduit. The operation member accepts user operation of driving the work implement and outputs a hydraulic pressure signal corresponding to the user operation. The controller controls an opening degree of the boom-lowering proportional solenoid valve. When an arm dump signal for performing dump operation of the arm is included in the hydraulic pressure signal, the controller sharply increases a current value outputted to the boom-lowering proportional solenoid valve, as compared with when an arm excavation signal for performing excavation operation of the arm is included in the hydraulic pressure signal.

According to the hydraulic excavator of the present invention, when the arm excavation signal is included in the hydraulic pressure signal, fluctuations in hydraulic pressure between the operation member and the boom-lowering proportional solenoid valve can be suppressed, and thus, occurrence of minute vibrations in the operation member can be suppressed. When the arm dump signal is included in the hydraulic pressure signal, the boom can be lowered quickly, and thus, occurrence of hunting in the work implement can be suppressed and the highly-accurate land leveling work can be performed.

In the hydraulic excavator, an amount of increase in current per unit time when the controller outputs, to the boom-lowering proportional solenoid valve, an instruction signal for instructing an increase in opening degree is larger when the arm dump signal is included in the hydraulic pressure signal than when the arm excavation signal is included in the hydraulic pressure signal. Thus, by relatively increasing the valve opening speed of the boom-lowering proportional solenoid valve when the arm dump signal is included in the hydraulic pressure signal, the boom can be lowered more quickly.

In the hydraulic excavator, when the arm dump signal is included in the hydraulic pressure signal, the controller increases, in a step manner, the current value outputted to the boom-lowering proportional solenoid valve. Thus, an amount of increase per unit time in current value outputted to the boom-lowering proportional solenoid valve becomes larger and the boom can be lowered more quickly.

In the hydraulic excavator, the work implement further includes a bucket. The bucket is attached to the arm and has a cutting edge. The controller controls the boom to prevent a position of the cutting edge from becoming lower than a design topography indicating a target shape of a land to be leveled. Thus, the land leveling work can be performed in accordance with the design topography, and therefore, the quality and efficiency of the land leveling work with the hydraulic excavator can be enhanced.

In the hydraulic excavator, the controller transmits and receives information to and from the outside by satellite communication. Thus, the construction based on the information transmitted and received to and from the outside becomes possible, and the highly-efficient and highly-accurate land leveling work with the hydraulic excavator can be realized.

Advantageous Effects of Invention

As described above, according to the present invention, when the arm excavation signal is included in the hydraulic pressure signal, fluctuations in hydraulic pressure between the operation member and the boom-lowering proportional solenoid valve can be suppressed, and thus, occurrence of minute vibrations in the operation member can be suppressed. When the arm dump signal is included in the hydraulic pressure signal, the boom can be lowered quickly, and thus, occurrence of hunting in the work implement can be suppressed.

DESCRIPTION OF EMBODIMENTS

An embodiment of the present invention will be described hereinafter with reference to the drawings.

First, a configuration of a hydraulic excavator to which an idea of the present invention is applicable will be described.

Figure 1:
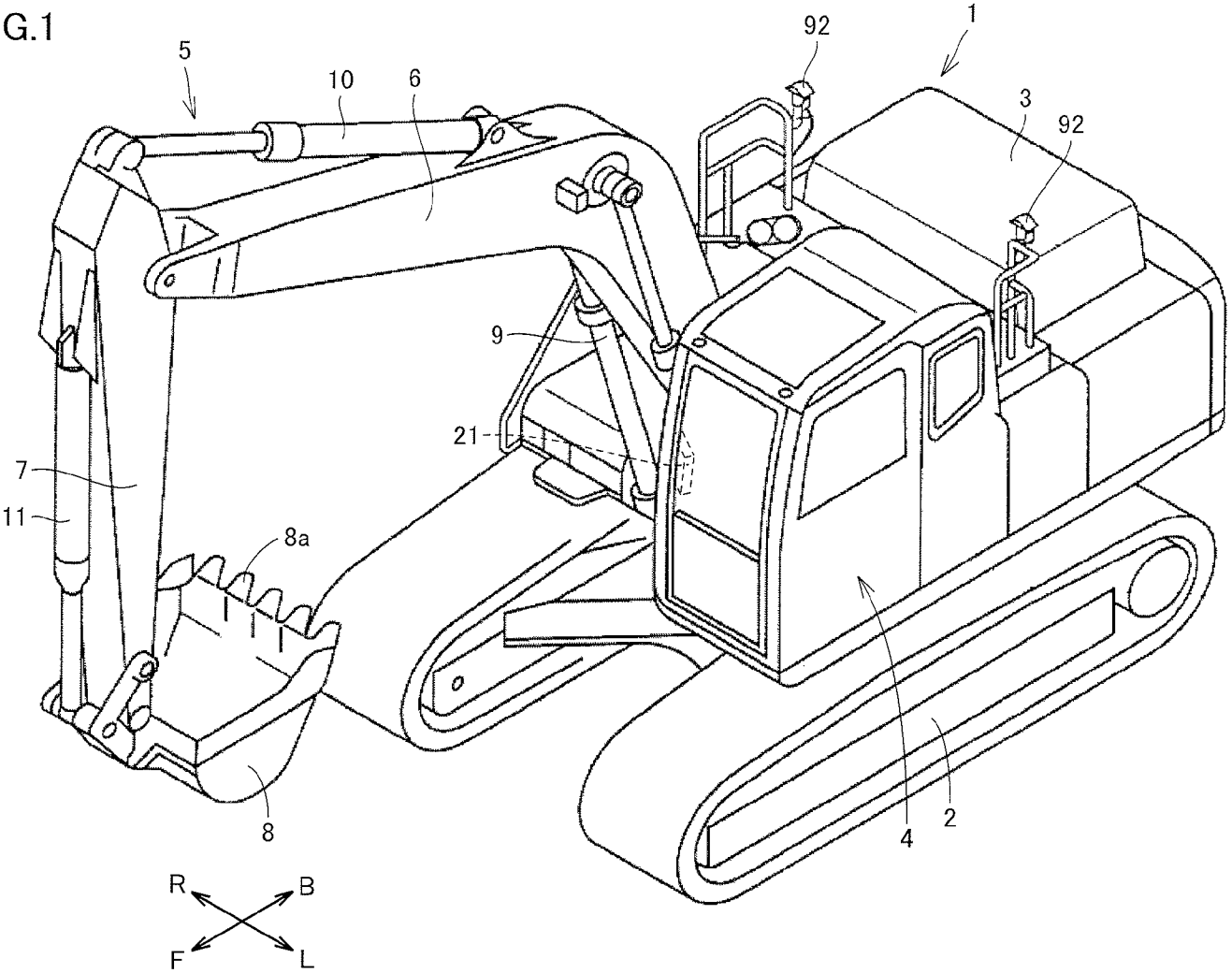
FIG. 1 is a schematic perspective view showing a configuration of a hydraulic excavator according to one embodiment of the present invention.

FIG. 1 is a schematic perspective view showing a configuration of a hydraulic excavator 1 according to one embodiment of the present invention. As shown in FIG. 1, hydraulic excavator 1 mainly includes a carriage 2, a revolving unit 3 and a work implement 5. Carriage 2 and revolving unit 3 constitute a work vehicle main body.

Carriage 2 has a pair of left and right crawler belts. It is configured to allow hydraulic excavator 1 to be self-propelled by rotation of the pair of crawler belts. Revolving unit 3 is disposed to be pivotable with respect to carriage 2.

Revolving unit 3 includes a cab 4 that is a space for an operator to operate hydraulic excavator 1. Cab 4 is included in the work vehicle main body. On the backward side B, revolving unit 3 includes an engine compartment that houses an engine, and a counter weight. In the present embodiment, the frontward side (front side) of the operator when seated in cab 4 will be referred to as frontward side F of revolving unit 3, and the backward side of the operator will be referred to as backward side B of revolving unit 3. The left side of the operator when seated will be referred to as left side L of revolving unit 3, and the right side of the operator when seated will be referred to as right side R of revolving unit 3. In the following description, it is assumed that the frontward-backward and left-right directions of revolving unit 3 match the frontward-backward and left-right directions of hydraulic excavator 1.

Work implement 5 that performs works such as soil excavation is pivotably supported by revolving unit 3 so as to be operable in the upward-downward direction. Work implement 5 has a boom 6 attached to a substantially central portion on frontward side F of revolving unit 3 so as to be operable in the upward-downward direction, an arm 7 attached to a tip of boom 6 so as to be operable in the backward-frontward direction, and a bucket 8 attached to a tip of arm 7 so as to be operable in the backward-frontward direction. Bucket 8 has a cutting edge **8*a* at a tip thereof. Boom 6, arm 7 and bucket 8 are configured to be driven by a boom cylinder 9, an arm cylinder 10 and a bucket cylinder 11** that are hydraulic cylinders, respectively.

Cab 4 is arranged on frontward side F and on left side L of revolving unit 3. With respect to cab 4, work implement 5 is provided on right side R that is one side portion side of cab 4. It should be noted that the arrangement of cab 4 and work implement 5 is not limited to the example shown in FIG. 1, and work implement 5 may be provided, for example, on the left side of cab 4 arranged on the frontward right side of revolving unit 3.

Figure 2:
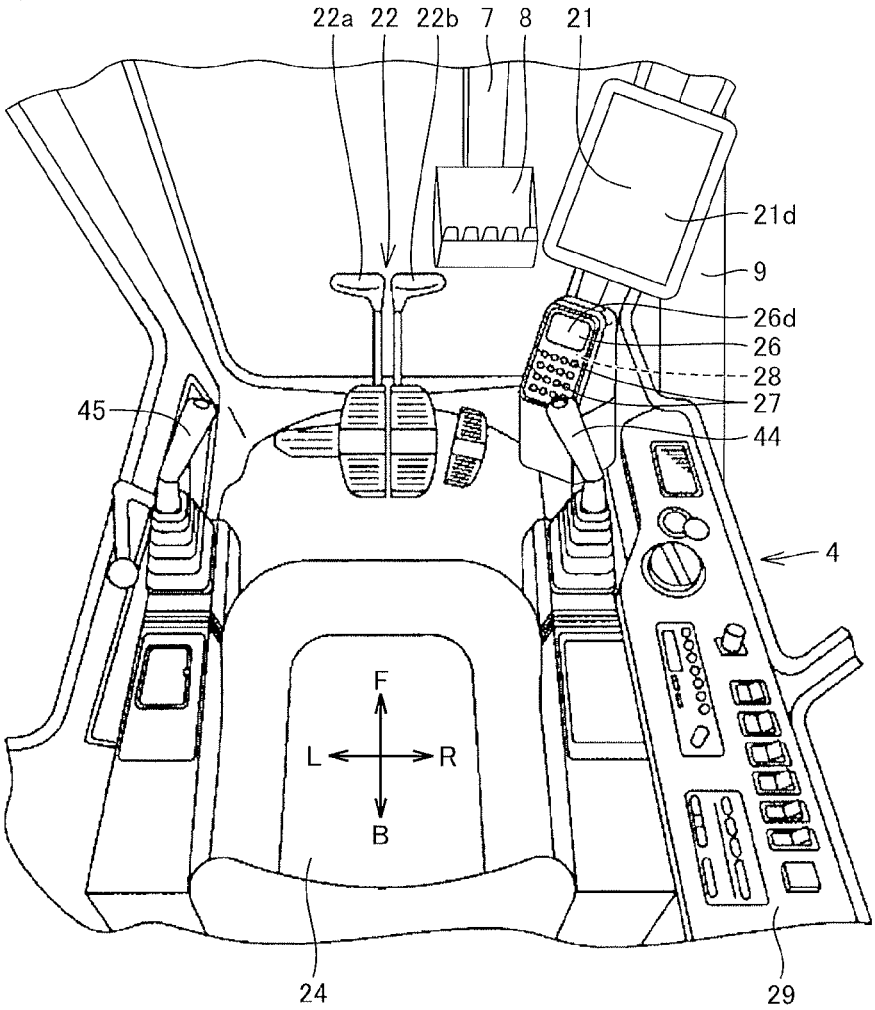
FIG. 2 is a perspective view of the inside of a cab of the hydraulic excavator.

FIG. 2 is a perspective view of the inside of cab 4 of hydraulic excavator 1. As shown in FIG. 2, an operator's seat 24 on which the operator facing toward frontward side F is seated is arranged inside cab 4. Cab 4 includes a roof portion arranged to cover operator's seat 24, and a plurality of pillars supporting the roof portion. The plurality of pillars have a front pillar arranged on frontward side F with respect to operator's seat 24, a rear pillar arranged on backward side B with respect to operator's seat 24, and an intermediate pillar arranged between the front pillar and the rear pillar. Each pillar extends along a vertical direction orthogonal to a horizontal surface, and is coupled to a floor portion and the roof portion of cab 4.

A space surrounded by each pillar and the floor and roof portions of cab 4 forms an interior space of cab 4. Operator's seat 24 is housed in the interior space of cab 4 and is arranged at a substantially center of the floor portion of cab 4. A side surface on left side L of cab 4 is provided with a door for the operator to get in or out of cab 4.

A front window is arranged on frontward side F with respect to operator's seat 24. The front window is made of a transparent material and the operator seated on operator's seat 24 can view the outside of cab 4 through the front window. For example, as shown in FIG. 2, the operator seated on operator's seat 24 can directly view bucket 8 excavating soil through the front window.

A monitor device 26 is disposed on frontward side F inside cab 4. Monitor device 26 is arranged at a corner on the frontward right side inside cab 4, and is supported by a support extending from the floor portion of cab 4.

For multipurpose use, monitor device 26 includes a planar display surface 26*d* having various monitor functions, a switch unit 27 having a plurality of switches, and a sound generator 28 that expresses by sound the contents displayed on display surface 26*d*. This display surface 26*d* is configured by a graphic indicator such as a liquid crystal indicator and an organic EL indicator. Although switch unit 27 includes a plurality of key switches, the present invention is not limited thereto. Switch unit 27 may include touch panel-type touch switches.

Travel control levers (left and right travel control levers) 22*a* and 22*b* for the left and right crawler belts are provided on frontward side F of operator's seat 24. Left and right travel control levers 22*a* and 22*b* form a travel control unit 22 for controlling carriage 2.

A first control lever 44 for the operator on cab 4 to control driving of boom 6 and bucket 8 of work implement 5 is provided on right side R of operator's seat 24. A switch panel 29 having various switches and the like is also provided on right side R of operator's seat 24. A second control lever 45 for the operator to control driving of arm 7 of work implement 5 and revolving of revolving unit 3 is provided on left side L of operator's seat 24.

A monitor 21 is arranged above monitor device 26. Monitor 21 has a planar display surface 21*d*. Monitor 21 is attached to the front pillar on right side R, which is the side close to work implement 5, of the pair of front pillars. Monitor 21 is arranged in front of the front pillar in the line of sight of the operator seated on operator's seat 24 toward the frontward right direction. By attaching monitor 21 to the front pillar on right side R in hydraulic excavator 1 including work implement 5 on right side R of cab 4, the operator can view both work implement 5 and monitor 21 with a small amount of line-of-sight movement.

Figure 3:
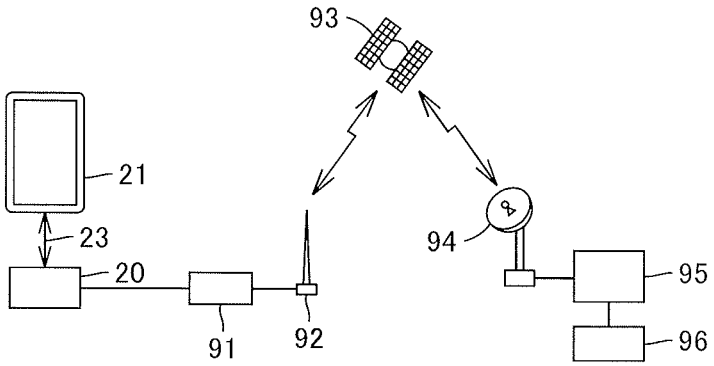
FIG. 3 is a schematic view showing a schematic configuration for transmitting and receiving information to and from the hydraulic excavator.

FIG. 3 is a schematic view showing a schematic configuration for transmitting and receiving information to and from hydraulic excavator 1. Hydraulic excavator 1 includes a controller 20. Controller 20 has a function of controlling operation of work implement 5, revolving of revolving unit 3, travel driving of carriage 2, and the like. Controller 20 and monitor 21 are connected by a bidirectional network communication cable 23 and form a communication network inside hydraulic excavator 1. Monitor 21 and controller 20 can mutually transmit and receive information via network communication cable 23. Each of monitor 21 and controller 20 is configured mainly by a computer device such as a microcomputer.

Information can be transmitted and received between controller 20 and an external monitoring station 96. In the present embodiment, controller 20 and monitoring station 96 communicate with each other by satellite communication. A communication terminal 91 having a satellite communication antenna 92 is connected to controller 20. As shown in FIG. 1, satellite communication antenna 92 is mounted on revolving unit 3. A network control station 95 linked by a dedicated line to a communication earth station 94 communicating with a communication satellite 93 by a dedicated communication line is connected to monitoring station 96 on the ground via the Internet and the like. As a result, data is transmitted and received between controller 20 and prescribed monitoring station 96 via communication terminal 91, communication satellite 93, communication earth station 94, and network control station 95.

Construction design data created by a three-dimensional CAD (Computer Aided Design) is prestored in controller 20. Monitor 21 updates and displays the externally-received current position of hydraulic excavator 1 on the screen in real time. As a result, the operator can constantly check the work state of hydraulic excavator 1.

Controller 20 compares the construction design data with the position and posture of work implement 5 in real time, and drives a hydraulic circuit based on the result of comparison, thereby controlling work implement 5. More specifically, controller 20 compares the target shape based on the construction design data of a work object (design topography or target design topography) with the position of bucket 8, and executes control to prevent cutting edge 8*a* of bucket 8 from being located lower than the design topography to prevent deeper excavation than the design topography. As a result, the construction efficiency and the construction accuracy can be enhanced, and high-quality construction can be easily performed.

Figure 4:
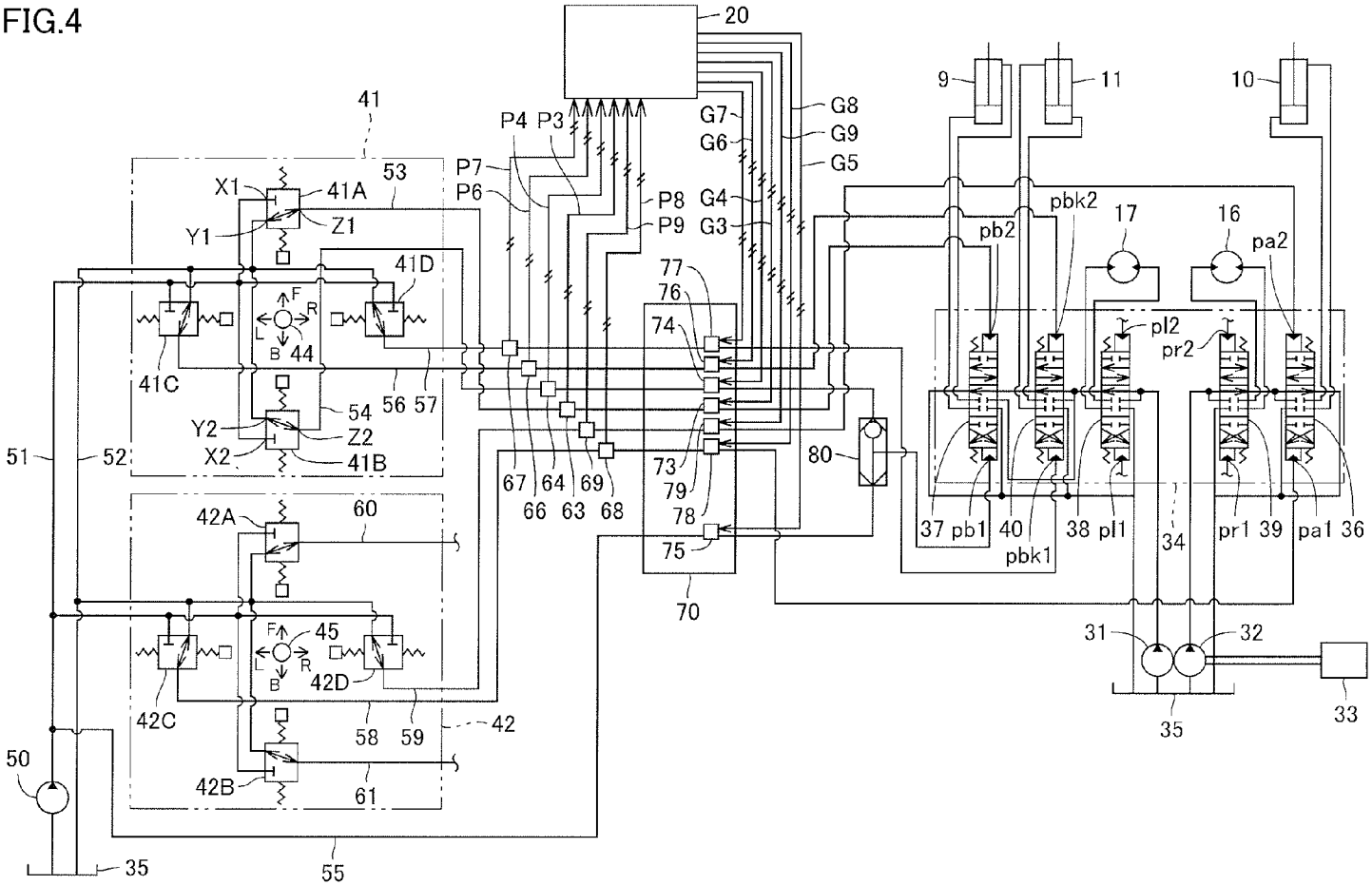
FIG. 4 is a hydraulic circuit diagram applied to the hydraulic excavator.

FIG. 4 is a hydraulic circuit diagram applied to hydraulic excavator 1. In a hydraulic system according to the present embodiment shown in FIG. 4, a first hydraulic pump 31 and a second hydraulic pump 32 are driven by an engine 33. First hydraulic pump 31 and second hydraulic pump 32 serve as a driving source for driving a hydraulic actuator such as boom cylinder 9, arm cylinder 10, bucket cylinder 11, travel motors 16 and 17, and the like. The hydraulic oil discharged from first hydraulic pump 31 and second hydraulic pump 32 is supplied to the hydraulic actuator via a main operation valve 34. The hydraulic oil supplied to the hydraulic actuator is discharged to a tank 35 via main operation valve 34.

Main operation valve 34 has a pilot switching valve for the arm 36, a pilot switching valve for the boom 37, a pilot switching valve for left travel 38, a pilot switching valve for right travel 39, and a pilot switching valve for the bucket 40.

Pilot switching valve for the arm 36 controls supply and discharge of the hydraulic oil to and from arm cylinder 10, and controls the operation of arm 7. Pilot switching valve for the boom 37 controls supply and discharge of the hydraulic oil to and from boom cylinder 9, and controls the operation of boom 6. Pilot switching valve for left travel 38 controls supply and discharge of the hydraulic oil to and from left travel motor 17, and controls the operation of left travel motor 17. Pilot switching valve for right travel 39 controls supply and discharge of the hydraulic oil to and from right travel motor 16, and controls the operation of right travel motor 16. Pilot switching valve for the bucket 40 controls supply and discharge of the hydraulic oil to and from bucket cylinder 11, and controls the operation of bucket 8.

Pilot switching valve for the arm 36 has a pair of pilot ports pa1 and pa2. Pilot switching valve for the boom 37 has a pair of pilot ports pb1 and pb2. Pilot switching valve for left travel 38 has a pair of pilot ports pl1 and pl2. Pilot switching valve for right travel 39 has a pair of pilot ports pr1 and pr2. Pilot switching valve for the bucket 40 has a pair of pilot ports pbk1 and pbk2. In accordance with the pressure (pilot pressure) of the pilot oil supplied to each pilot port, each of pilot switching valves 36 to 40 is controlled.

The pilot pressure applied to each of the pilot ports of pilot switching valve for the boom 37 and pilot switching valve for the bucket 40 is controlled by operating a first control lever device 41. The pilot pressure applied to each of the pilot ports of pilot switching valve for the arm 36 is controlled by operating a second control lever device 42. The operator operates first control lever device 41 and second control lever device 42, thereby controlling the operation of work implement 5 and the revolving operation of revolving unit 3. First control lever device 41 and second control lever device 42 constitute an operation member for accepting the operator's operation of driving work implement 5.

The pilot pressure applied to each of the pilot ports of pilot switching valve for left travel 38 and pilot switching valve for right travel 39 is controlled by operating left and right travel control levers 22*a* and 22*b* shown in FIG. 2. The operator operates left and right travel control levers 22*a* and 22*b*, thereby controlling the travelling operation of carriage 2.

First control lever device 41 has first control lever 44 operated by the operator. First control lever device 41 has a first pilot pressure control valve 41A, a second pilot pressure control valve 41B, a third pilot pressure control valve 41C, and a fourth pilot pressure control valve 41D. First pilot pressure control valve 41A, second pilot pressure control valve 41B, third pilot pressure control valve 41C, and fourth pilot pressure control valve 41D are provided to correspond to the four directions, i.e., the frontward-backward and left-right directions, of first control lever 44.

Second control lever device 42 has second control lever 45 operated by the operator. Second control lever device 42 has a fifth pilot pressure control valve 42A, a sixth pilot pressure control valve 42B, a seventh pilot pressure control valve 42C, and an eighth pilot pressure control valve 42D. Fifth pilot pressure control valve 42A, sixth pilot pressure control valve 42B, seventh pilot pressure control valve 42C, and eighth pilot pressure control valve 42D are provided to correspond to the four directions, i.e., the frontward-backward and left-right directions, of second control lever 45.

Pilot pressure control valves 41A to 41D and 42A to 42D for controlling driving of hydraulic cylinders 9, 10 and 11 for work implement 5 as well as a swing motor are connected to first control lever 44 and second control lever 45, respectively. Pilot pressure control valves for controlling driving of right and left travel motors 16 and 17 are connected to left and right travel control levers 22*a* and 22*b*, respectively.

First pilot pressure control valve 41A has a first pump port X1, a first tank port Y1 and a first supply/discharge port Z1. First pump port X1 is connected to a pump flow path 51. First tank port Y1 is connected to a tank flow path 52. Pump flow path 51 and tank flow path 52 are connected to tank 35 that stores the pilot oil. A third hydraulic pump 50 is provided in pump flow path 51. Third hydraulic pump 50 is different from first hydraulic pump 31 and second hydraulic pump 32 described above. However, instead of third hydraulic pump 50, first hydraulic pump 31 or second hydraulic pump 32 may be used.

First supply/discharge port Z1 is connected to a first pilot conduit 53. First pilot conduit 53 connects first pilot pressure control valve 41A of first control lever device 41 and second pilot port pb2 of pilot switching valve for the boom 37.

In accordance with the operation of first control lever 44, first pilot pressure control valve 41A is switched between an output state and a discharge state. In the output state, first pilot pressure control valve 41A causes first pump port X1 and first supply/discharge port Z1 to communicate with each other, and outputs the pilot oil having a pressure corresponding to an amount of operation of first control lever 44 from first supply/discharge port Z1 to first pilot conduit 53. In the discharge state, first pilot pressure control valve 41A causes first tank port Y1 and first supply/discharge port Z1 to communicate with each other.

Second pilot pressure control valve 41B has a second pump port X2, a second tank port Y2 and a second supply/discharge port Z2. Second pump port X2 is connected to pump flow path 51. Second tank port Y2 is connected to tank flow path 52.

Second supply/discharge port Z2 is connected to a second pilot conduit 54. Second pilot conduit 54 connects second pilot pressure control valve 41B of first control lever device 41 and first pilot port pb1 of pilot switching valve for the boom 37.

In accordance with the operation of first control lever 44, second pilot pressure control valve 41B is switched between an output state and a discharge state. In the output state, second pilot pressure control valve 41B causes second pump port X2 and second supply/discharge port Z2 to communicate with each other, and outputs the pilot oil having a pressure corresponding to an amount of operation of first control lever 44 from second supply/discharge port Z2 to second pilot conduit 54. In the discharge state, second pilot pressure control valve 41B causes second tank port Y2 and second supply/discharge port Z2 to communicate with each other.

First pilot pressure control valve 41A and second pilot pressure control valve 41B form a pair and correspond to the operation directions of first control lever 44 that are opposite to each other. For example, first pilot pressure control valve 41A corresponds to the operation of first control lever 44 toward frontward side F, and second pilot pressure control valve 41B corresponds to the operation of first control lever 44 toward backward side B. Either first pilot pressure control valve 41A or second pilot pressure control valve 41B is selected in accordance with the operation of first control lever 44. When first pilot pressure control valve 41A is in the output state, second pilot pressure control valve 41B is in the discharge state. When first pilot pressure control valve 41A is in the discharge state, second pilot pressure control valve 41B is in the output state.

First pilot pressure control valve 41A controls supply and discharge of the pilot oil to and from second pilot port pb2 of pilot switching valve for the boom 37. Second pilot pressure control valve 41B controls supply and discharge of the pilot oil to and from first pilot port pb1 of pilot switching valve for the boom 37. In accordance with the operation of first control lever 44, supply and discharge of the hydraulic oil to and from boom cylinder 9 are controlled, and extension and contraction of boom cylinder 9 are controlled.

First control lever 44 accepts the user operation of driving boom 6. First control lever 44 outputs, via second pilot pressure control valve 41B, a hydraulic pressure signal corresponding to the user operation of trying to raise boom 6. First control lever 44 outputs, via first pilot pressure control valve 41A, a hydraulic pressure signal corresponding to the user operation of trying to lower boom 6. The hydraulic pressure signals outputted in accordance with the operation of first control lever 44 may include a boom-raising signal for performing the operation for raising boom 6 and a boom-lowering signal for performing the operation for lowering boom 6. As a result, the operation for raising or lowering boom 6 is controlled in accordance with the operation of first control lever 44.

First pilot port pb1 of pilot switching valve for the boom 37 has a function as a boom-raising pilot port supplied with the pilot oil at the time of the operation for raising boom 6. Second pilot port pb2 of pilot switching valve for the boom 37 has a function as a boom-lowering pilot port supplied with the pilot oil at the time of the operation for lowering boom 6.

The pressure of the pilot oil supplied to first pilot conduit 53 via first pilot pressure control valve 41A is detected by a hydraulic pressure sensor 63. Hydraulic pressure sensor 63 outputs, to controller 20, a pressure signal P3 that is an electric detection signal corresponding to the detected hydraulic pressure. In addition, the pressure of the pilot oil supplied to second pilot conduit 54 via second pilot pressure control valve 41B is detected by a hydraulic pressure sensor 64. Hydraulic pressure sensor 64 outputs, to controller 20, a pressure signal P4 that is an electric detection signal corresponding to the detected hydraulic pressure.

A relay block 70 is provided in a hydraulic pressure path connecting first and second control lever devices 41 and 42 and main operation valve 34. Relay block 70 is configured to include a plurality of proportional solenoid valves 73 to 79. Proportional solenoid valve 73 is provided in first pilot conduit 53. Hydraulic pressure sensor 63 is provided between first pilot pressure control valve 41A and proportional solenoid valve 73 in first pilot conduit 53. Proportional solenoid valve 74 is provided in second pilot conduit 54. Hydraulic pressure sensor 64 is provided between second pilot pressure control valve 41B and proportional solenoid valve 74 in second pilot conduit 54. Proportional solenoid valves 73 and 74 are provided to control the operation for moving boom 6 upwardly and downwardly in accordance with the operation of first control lever 44.

Based on the hydraulic pressure of first pilot conduit 53 detected by hydraulic pressure sensor 63, controller 20 controls proportional solenoid valve 73. Hydraulic pressure sensor 63 has a function as a first pressure sensor for detecting the hydraulic pressure generated in first pilot conduit 53 between first pilot pressure control valve 41A and proportional solenoid valve 73 in accordance with the operation of first control lever 44.

In accordance with the hydraulic pressure detected by hydraulic pressure sensor 63, controller 20 outputs an instruction signal for instructing boom-lowering to proportional solenoid valve 73. Controller 20 outputs an instruction signal G3 to proportional solenoid valve 73 and adjusts the opening degree thereof. As a result, controller 20 changes a flow rate of the pilot oil flowing through first pilot conduit 53, and controls the pilot pressure transmitted to second pilot port pb2 of pilot switching valve for the boom 37. In accordance with the degree of the pilot pressure transmitted to second pilot port pb2, the speed of boom 6 when lowered is adjusted.

Based on the hydraulic pressure of second pilot conduit 54 detected by hydraulic pressure sensor 64, controller 20 controls proportional solenoid valve 74. Hydraulic pressure sensor 64 has a function as a second pressure sensor for detecting the hydraulic pressure generated in second pilot conduit 54 between second pilot pressure control valve 41B and proportional solenoid valve 74 in accordance with the operation of first control lever 44.

In accordance with the hydraulic pressure detected by hydraulic pressure sensor 64, controller 20 outputs an instruction signal for instructing boom-raising to proportional solenoid valve 74. Controller 20 outputs an instruction signal G4 to proportional solenoid valve 74 and adjusts the opening degree thereof. As a result, controller 20 changes a flow rate of the pilot oil flowing through second pilot conduit 54, and controls the pilot pressure transmitted to first pilot port pb1 of pilot switching valve for the boom 37. In accordance with the degree of the pilot pressure transmitted to first pilot port pb1, the speed of boom 6 when raised is adjusted.

A shuttle valve 80 is provided in second pilot conduit 54. Shuttle valve 80 has two entrance ports and one exit port. The exit port of shuttle valve 80 is connected to first pilot port pb1 of pilot switching valve for the boom 37 via second pilot conduit 54. One entrance port of shuttle valve 80 is connected to second pilot pressure control valve 41B via second pilot conduit 54. The other entrance port of shuttle valve 80 is connected to a pump flow path 55.

Pump flow path 55 branches off from pump flow path 51. One end of pump flow path 55 is connected to pump flow path 51 and the other end of pump flow path 55 is connected to shuttle valve 80. The pilot oil transported by third hydraulic pump 50 flows to first control lever device 41 and second control lever device 42 via pump flow path 51, and also flows to shuttle valve 80 via pump flow paths 51 and 55.

Shuttle valve 80 is a shuttle valve of higher pressure priority type. Shuttle valve 80 compares the hydraulic pressure in second pilot conduit 54 connected to one entrance port and the hydraulic pressure in pump flow path 55 connected to the other entrance port, and selects the higher pressure. Shuttle valve 80 causes a higher pressure-side flow path of second pilot conduit 54 and pump flow path 55 to communicate with the exit port, and supplies the pilot oil flowing through this higher pressure-side flow path to first pilot port pb1 of pilot switching valve for the boom 37.

A proportional solenoid valve 75 included in relay block 70 is provided in pump flow path 55. Proportional solenoid valve 75 is a valve for forcible boom-raising intervention. Proportional solenoid valve 75 receives an instruction signal G5 outputted from controller 20, and adjusts the opening degree thereof. Regardless of the operation of first control lever device 41 by the operator, controller 20 outputs instruction signal G5 to proportional solenoid valve 75 and adjusts the opening degree thereof. As a result, controller 20 changes a flow rate of the pilot oil flowing through pump flow path 55, and controls the pilot pressure transmitted to first pilot port pb1 of pilot switching valve for the boom 37. By adjustment of the opening degree of proportional solenoid valve 75, controller 20 controls the operation for forcibly raising boom 6.

Third pilot pressure control valve 41C and fourth pilot pressure control valve 41D have configurations similar to those of first pilot pressure control valve 41A and second pilot pressure control valve 41B described above. Similarly to first pilot pressure control valve 41A and second pilot pressure control valve 41B, third pilot pressure control valve 41C and fourth pilot pressure control valve 41D form a pair, and either third pilot pressure control valve 41C or fourth pilot pressure control valve 41D is selected in accordance with the operation of first control lever 44. For example, third pilot pressure control valve 41C corresponds to the operation of first control lever 44 toward left side L, and fourth pilot pressure control valve 41D corresponds to the operation of first control lever 44 toward right side R.

Third pilot pressure control valve 41C is connected to pump flow path 51, tank flow path 52 and a third pilot conduit 56. Third pilot conduit 56 connects third pilot pressure control valve 41C of first control lever device 41 and second pilot port pbk2 of pilot switching valve for the bucket 40. Fourth pilot pressure control valve 41D is connected to pump flow path 51, tank flow path 52 and a fourth pilot conduit 57. Fourth pilot conduit 57 connects fourth pilot pressure control valve 41D of first control lever device 41 and first pilot port pbk1 of pilot switching valve for the bucket 40.

Third pilot pressure control valve 41C controls supply and discharge of the pilot oil to and from second pilot port pbk2 of pilot switching valve for the bucket 40. Fourth pilot pressure control valve 41D controls supply and discharge of the pilot oil to and from first pilot port pbk1 of pilot switching valve for the bucket 40. In accordance with the operation of first control lever 44, supply and discharge of the hydraulic oil to and from bucket cylinder 11 are controlled, and extension and contraction of bucket cylinder 11 are controlled.

First control lever 44 accepts the user operation of driving bucket 8. First control lever 44 outputs, via fourth pilot pressure control valve 41D, a hydraulic pressure signal corresponding to the user operation of trying to move bucket 8 toward an open direction in which cutting edge 8*a* of bucket 8 moves away from revolving unit 3. First control lever 44 outputs, via third pilot pressure control valve 41C, a hydraulic pressure signal corresponding to the user operation of trying to move bucket 8 toward an excavation direction in which cutting edge 8*a* of bucket 8 comes closer to revolving unit 3. The hydraulic pressure signals outputted in accordance with the operation of first control lever 44 may include a bucket open signal for performing the opening operation of bucket 8 and a bucket excavation signal for performing the excavation operation of bucket 8. As a result, the operation of bucket 8 toward the excavation direction or the open direction is controlled in accordance with the operation of first control lever 44.

The pressure of the pilot oil supplied to third pilot conduit 56 via third pilot pressure control valve 41C is detected by a hydraulic pressure sensor 66. Hydraulic pressure sensor 66 outputs, to controller 20, a pressure signal P6 corresponding to the detected hydraulic pressure. A proportional solenoid valve 76 is provided in third pilot conduit 56. In accordance with the hydraulic pressure detected by hydraulic pressure sensor 66, controller 20 outputs an instruction signal G6 to proportional solenoid valve 76, and controls the pilot pressure transmitted to second pilot port pbk2 of pilot switching valve for the bucket 40. In accordance with the degree of the pilot pressure transmitted to second pilot port pbk2, the speed of bucket 8 when moved toward the excavation direction is adjusted.

The pressure of the pilot oil supplied to fourth pilot conduit 57 via fourth pilot pressure control valve 41D is detected by a hydraulic pressure sensor 67. Hydraulic pressure sensor 67 outputs, to controller 20, a pressure signal P7 corresponding to the detected hydraulic pressure. A proportional solenoid valve 77 is provided in fourth pilot conduit 57. In accordance with the hydraulic pressure detected by hydraulic pressure sensor 67, controller 20 outputs an instruction signal G7 to proportional solenoid valve 77, and controls the pilot pressure transmitted to first pilot port pbk1 of pilot switching valve for the bucket 40. In accordance with the degree of the pilot pressure transmitted to first pilot port pbk1, the speed of bucket 8 when moved toward the open direction is adjusted.

Fifth pilot pressure control valve 42A, sixth pilot pressure control valve 42B, seventh pilot pressure control valve 42C, and eighth pilot pressure control valve 42D have configurations similar to those of first pilot pressure control valve 41A, second pilot pressure control valve 41B, third pilot pressure control valve 41C, and fourth pilot pressure control valve 41D described above. Fifth pilot pressure control valve 42A and sixth pilot pressure control valve 42B form a pair, and either fifth pilot pressure control valve 42A or sixth pilot pressure control valve 42B is selected in accordance with the operation of second control lever 45. Seventh pilot pressure control valve 42C and eighth pilot pressure control valve 42D form a pair, and either seventh pilot pressure control valve 42C or eighth pilot pressure control valve 42D is selected in accordance with the operation of second control lever 45.

For example, fifth pilot pressure control valve 42A corresponds to the operation of second control lever 45 toward frontward side F, and sixth pilot pressure control valve 42B corresponds to the operation of second control lever 45 toward backward side B. Seventh pilot pressure control valve 42C corresponds to the operation of second control lever 45 toward left side L, and eighth pilot pressure control valve 42D corresponds to the operation of second control lever 45 toward right side R.

Fifth pilot pressure control valve 42A is connected to pump flow path 51, tank flow path 52 and a fifth pilot conduit 60. Sixth pilot pressure control valve 42B is connected to pump flow path 51, tank flow path 52 and a sixth pilot conduit 61. A not-shown electric motor for revolving revolving unit 3 is controlled based on the pressure of the pilot oil supplied to fifth pilot conduit 60 via fifth pilot pressure control valve 42A and the pressure of the pilot oil supplied to sixth pilot conduit 61 via sixth pilot pressure control valve 42B. Rotational driving of this electric motor when the pilot oil is supplied to fifth pilot conduit 60 is opposite to rotational driving of the electric motor when the pilot oil is supplied to sixth pilot conduit 61. In accordance with the direction of operation and the amount of operation of second control lever 45, the revolving direction and the revolving speed of revolving unit 3 are controlled.

Seventh pilot pressure control valve 42C is connected to pump flow path 51, tank flow path 52 and a seventh pilot conduit 58. Seventh pilot conduit 58 connects seventh pilot pressure control valve 42C of second control lever device 42 and first pilot port pa1 of pilot switching valve for the arm 36. Eighth pilot pressure control valve 42D is connected to pump flow path 51, tank flow path 52 and an eighth pilot conduit 59. Eighth pilot conduit 59 connects eighth pilot pressure control valve 42D of second control lever device 42 and second pilot port pa2 of pilot switching valve for the arm 36.

Seventh pilot pressure control valve 42C controls supply and discharge of the pilot oil to and from first pilot port pa1 of pilot switching valve for the arm 36. Eighth pilot pressure control valve 42D controls supply and discharge of the pilot oil to and from second pilot port pa2 of pilot switching valve for the arm 36. In accordance with the operation of second control lever 45, supply and discharge of the hydraulic oil to and from arm cylinder 10 are controlled, and extension and contraction of arm cylinder 10 are controlled.

Second control lever 45 accepts the user operation of driving arm 7. Second control lever 45 outputs, via eighth pilot pressure control valve 42D, a hydraulic pressure signal corresponding to the user operation of trying to move arm 7 toward an arm excavation direction in which arm 7 comes closer to revolving unit 3. Second control lever 45 outputs, via eighth pilot pressure control valve 42D, an arm excavation signal for performing the excavation operation of arm 7.

Second control lever 45 outputs, via seventh pilot pressure control valve 42C, a hydraulic pressure signal corresponding to the user operation of trying to move arm 7 toward an arm dump direction in which arm 7 moves away from revolving unit 3. Second control lever 45 outputs, via seventh pilot pressure control valve 42C, an arm dump signal for performing the dump operation of arm 7. The hydraulic pressure signals outputted in accordance with the operation of second control lever 45 may include the arm dump signal for performing the dump operation of arm 7 and the arm excavation signal for performing the excavation operation of arm 7. As a result, the operation of arm 7 toward the excavation direction or the dump direction is controlled in accordance with the operation of second control lever 45.

The pressure of the pilot oil supplied to seventh pilot conduit 58 via seventh pilot pressure control valve 42C is detected by a hydraulic pressure sensor 68. Hydraulic pressure sensor 68 outputs, to controller 20, a pressure signal P8 corresponding to the detected hydraulic pressure. A proportional solenoid valve 78 is provided in seventh pilot conduit 58. In accordance with the hydraulic pressure detected by hydraulic pressure sensor 68, controller 20 outputs an instruction signal G8 to proportional solenoid valve 78, and controls the pilot pressure transmitted to first pilot port pa1 of pilot switching valve for the arm 36. In accordance with the degree of the pilot pressure transmitted to first pilot port pa1, the speed of arm 7 when moved toward the arm dump direction is adjusted.

The pressure of the pilot oil supplied to eighth pilot conduit 59 via eighth pilot pressure control valve 42D is detected by a hydraulic pressure sensor 69. Hydraulic pressure sensor 69 outputs, to controller 20, a pressure signal P9 corresponding to the detected hydraulic pressure. A proportional solenoid valve 79 is provided in eighth pilot conduit 59. In accordance with the hydraulic pressure detected by hydraulic pressure sensor 69, controller 20 outputs an instruction signal G9 to proportional solenoid valve 79, and controls the pilot pressure transmitted to second pilot port pa2 of pilot switching valve for the arm 36. In accordance with the degree of the pilot pressure transmitted to second pilot port pa2, the speed of arm 7 when moved toward the arm excavation direction is adjusted.

The setting of a correspondence relationship between the operation directions of first and second control levers 44 and 45 and the operation of work implement 5 and the revolving operation of revolving unit 3 may be switchable to desired patterns. For example, first pilot pressure control valve 41A and second pilot pressure control valve 41B may correspond to the operations of first control lever 44 toward the frontward and backward directions, respectively, or may correspond to the operations of first control lever 44 toward the left and right directions, respectively.

Figure 5:
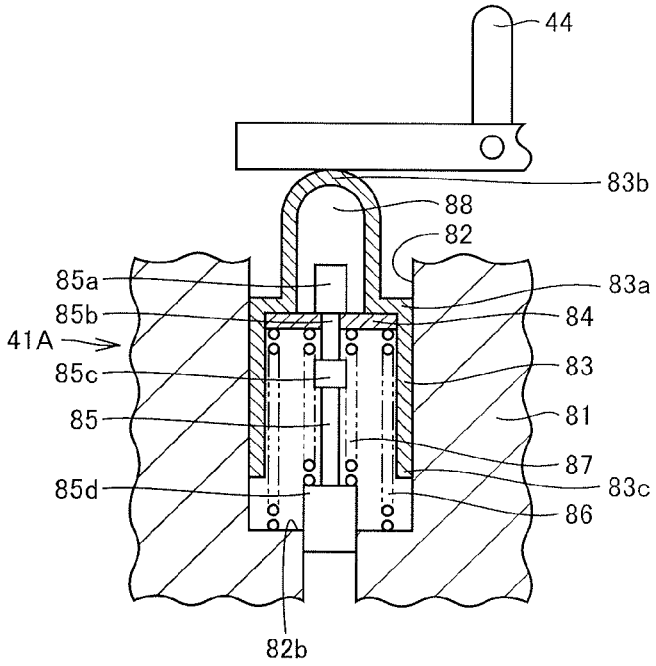
FIG. 5 is a cross-sectional view of a pilot pressure control valve at the neutral position.

FIG. 5 is a cross-sectional view of the pilot pressure control valve at the neutral position. Although first pilot pressure control valve 41A is described by way of example in FIG. 5 and below-described FIG. 6, other pilot pressure control valves 41B to 41D and 42A to 42D also have configurations similar to that of first pilot pressure control valve 41A and the operations thereof are also the same.

A hollow and closed-end cylindrical cylinder portion 82 is formed in a valve main body 81, and a piston 83 is arranged inside cylinder portion 82. Piston 83 is provided to be capable of reciprocating along the axial direction of cylinder portion 82. Piston 83 has a stepped portion 83*a*, and a diameter of piston 83 changes at stepped portion 83*a*. Piston 83 has an upper end 83*b* at an end on the side where the diameter gets smaller at stepped portion 83*a* (on the upper side in FIGS. 5 and 6), and has a lower end 83*e* at an end on the side where the diameter gets larger at stepped portion 83*a* (on the lower side in FIGS. 5 and 6). The diameter of lower end 83*c* is larger than that of upper end 83*b*, and upper end 83*b* is provided to have a smaller diameter than that of lower end 83*c*.

At upper end 83*b*, piston 83 is in contact with first control lever 44. Upper end 83*b* has a spherical outer surface, which allows piston 83 to smoothly move along the axial direction of cylinder portion 82 in line with the operation of first control lever 44. Lower end 83*c* of piston 83 faces a bottom surface 82*b* of cylinder portion 82.

Piston 83 is formed to be hollow. A plate-like retainer 84 is provided on an inner wall of stepped portion 83*a* of piston 83. Retainer 84 has, at a central portion thereof, a through hole passing through retainer 84 in the thickness direction. A spool 85 is arranged to pass through the through hole of retainer 84. Spool 85 is arranged in a hollow space defined by piston 83. Retainer 84 is provided to be capable of reciprocating along the axial direction of cylinder portion 82 in line with the operation of piston 83. Spool 85 is also provided to be capable of reciprocating along the axial direction of cylinder portion 82.

Spool 85 has a tip large-diameter portion 85*a* that is an end on the upper end 83*b* side of piston 83, a small-diameter portion 85*b* having a smaller diameter than that of tip large-diameter portion 85*a*, and an intermediate large-diameter portion 85*c* having a larger diameter than that of small-diameter portion 85*b*. As compared with the through hole formed in retainer 84, tip large-diameter portion 85*a* and intermediate large-diameter portion 85*c* are provided to have larger diameters than that of the through hole, and small-diameter portion 85*b* is provided to have a smaller diameter than that of the through hole. Small-diameter portion 85*b* can be inserted into the through hole of retainer 84, whereas tip large-diameter portion 85*a* and intermediate large-diameter portion 85*c* cannot be inserted into the through hole of retainer 84.

The length of small-diameter portion 85*b* is larger than the thickness of retainer 84. Therefore, within the range of the length of small-diameter portion 85*b*, spool 85 is provided to be capable of relatively reciprocating along the axial direction of cylinder portion 82 with respect to retainer 84. Tip large-diameter portion 85*a* and intermediate large-diameter portion 85*c* restrict the relative upward and downward movement of spool 85 with respect to retainer 84. Within the range from a position where retainer 84 is in contact with tip large-diameter portion 85*a* to a position where retainer 84 is in contact with intermediate large-diameter portion 85*c*, spool 85 is relatively movable with respect to retainer 84.

A main spring 86 is provided between retainer 84 and bottom surface 82*b* of cylinder portion 82. Main spring 86 pushes up piston 83 in the upward direction in FIG. 5 and retains piston 83, and presses retainer 84 against piston 83. Spool 85 has a stepped portion 85*d*, and a spring 87 is provided between this stepped portion 85*d* and retainer 84. Spring 87 is provided on an outer circumference of spool 85 and on an inner circumference of main spring 86. Spring 87 defines a relative position of retainer 84 and spool 85 such that spool 85 is pushed down in the downward direction in FIG. 5 and tip large-diameter portion 85*a* of spool 85 comes into contact with retainer 84.

Main spring 86 generates reactive force in the direction in which lower end 83*c* of piston 83 comes closer to bottom surface 82*b* of cylinder portion 82 (in the downward direction in the figure), the reactive force being proportional to an amount of relative movement of piston 83 with respect to cylinder portion 82. Spring 87 generates reactive force in the direction in which intermediate large-diameter portion 85*c* of spool 85 comes closer to retainer 84, the reactive force being proportional to an amount of relative movement of spool 85 with respect to retainer 84.

FIG. 5 shows a state of first pilot pressure control valve 41A when first control lever 44 is in a neutral position where first control lever 44 is not operated toward any directions. At this time, retainer 84 is pressed against stepped portion 83*a* of piston 83 by the action of main spring 86. In addition, tip large-diameter portion 85*a* of spool 85 and retainer 84 are in contact with each other and retained by the action of spring 87.

Figure 6:
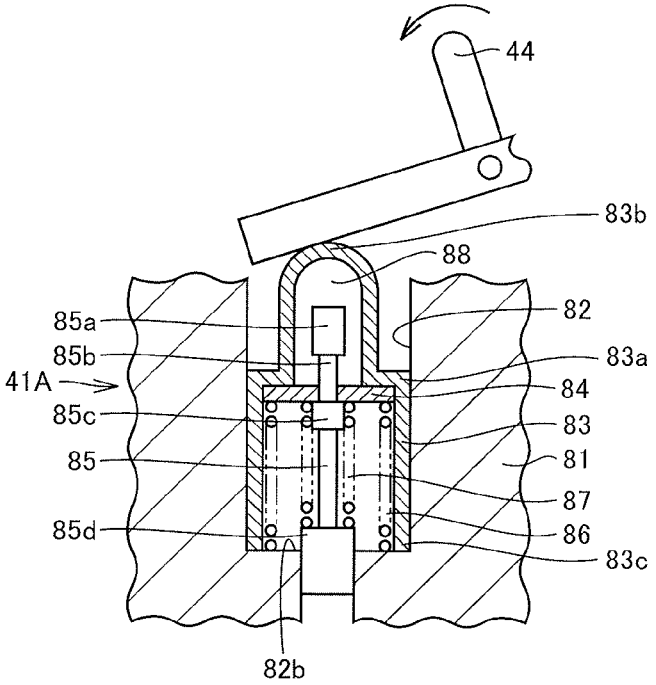
FIG. 6 is a cross-sectional view of the pilot pressure control valve during the valve operation.

FIG. 6 is a cross-sectional view of the pilot pressure control valve during the valve operation. FIG. 6 shows a state in which first control lever 44 is operated toward the first pilot pressure control valve 41A side and upper end 83*b* of piston 83 is pressed by first control lever 44, and as a result, piston 83 is displaced in the downward direction in FIG. 6. Piston 83 relatively moves with respect to cylinder portion 82 in the downward direction in FIG. 6, i.e., in the direction in which lower end 83*c* of piston 83 comes closer to bottom surface 82*b* of cylinder portion 82. Retainer 84 is pushed down by stepped portion 83*a* of piston 83 and relatively moves together with piston 83 in the direction in which retainer 84 comes closer to bottom surface 82*b*.

Retainer 84 relatively moves with respect to spool 85 in the direction in which retainer 84 moves away from tip large-diameter portion 85*a* of spool 85 and comes closer to intermediate large-diameter portion 85*c*. While retainer 84 is moving along small-diameter portion 85*b* of spool 85, retainer 84 does not apply stress to spool 85 and spool 85 is maintained in the original position shown in FIG. 5. When piston 83 is further pushed down with retainer 84 coming into contact with intermediate large-diameter portion 85*c* as a result of continued movement of retainer 84, spool 85 relatively moves with respect to cylinder portion 82, together with piston 83 and retainer 84.

Due to this movement of spool 85, the pilot oil having a prescribed pressure is supplied from first pilot pressure control valve 41A to first pilot conduit 53. As a result, the pilot pressure is supplied to pilot port pb2 of pilot switching valve for the boom 37 and the operation of boom 6 in the direction of lowering boom 6 is controlled. A flow rate of the hydraulic oil supplied to boom cylinder 9 is determined by the operation of first control lever 44 by the operator. As the inclination angle of first control lever 44 becomes larger, the flow rate of the pilot oil becomes larger and the moving speed of the spool of pilot switching valve for the boom 37 also becomes larger.

The land leveling work with hydraulic excavator 1 having the aforementioned configuration will be described below. Arm 7 of work implement 5 can be operated both in the excavation direction in which arm 7 comes closer to revolving unit 3 and in the dump direction in which arm 7 moves away from revolving unit 3. Whether arm 7 is operated toward the excavation direction or the dump direction is detected by inclusion of any one of the arm excavation signal and the arm dump signal in the hydraulic pressure signals outputted by second control lever device 42. Based on the pressure of the pilot oil detected by hydraulic pressure sensors 68 and 69, controller 20 may determine whether arm excavation or arm dump is performed.

For example, when the pressure of the pilot oil detected by hydraulic pressure sensor 68 provided in seventh pilot conduit 58 is higher than a prescribed value, it is determined that seventh pilot pressure control valve 42C is in the output state and the arm dump signal, which is the hydraulic pressure signal for operating arm 7 toward the dump direction, is being outputted. When the pressure of the pilot oil detected by hydraulic pressure sensor 69 provided in eighth pilot conduit 59 is higher than a prescribed value, it is determined that eighth pilot pressure control valve 42D is in the output state and the arm excavation signal, which is the hydraulic pressure signal for operating arm 7 toward the excavation direction, is being outputted.

Figure 7:
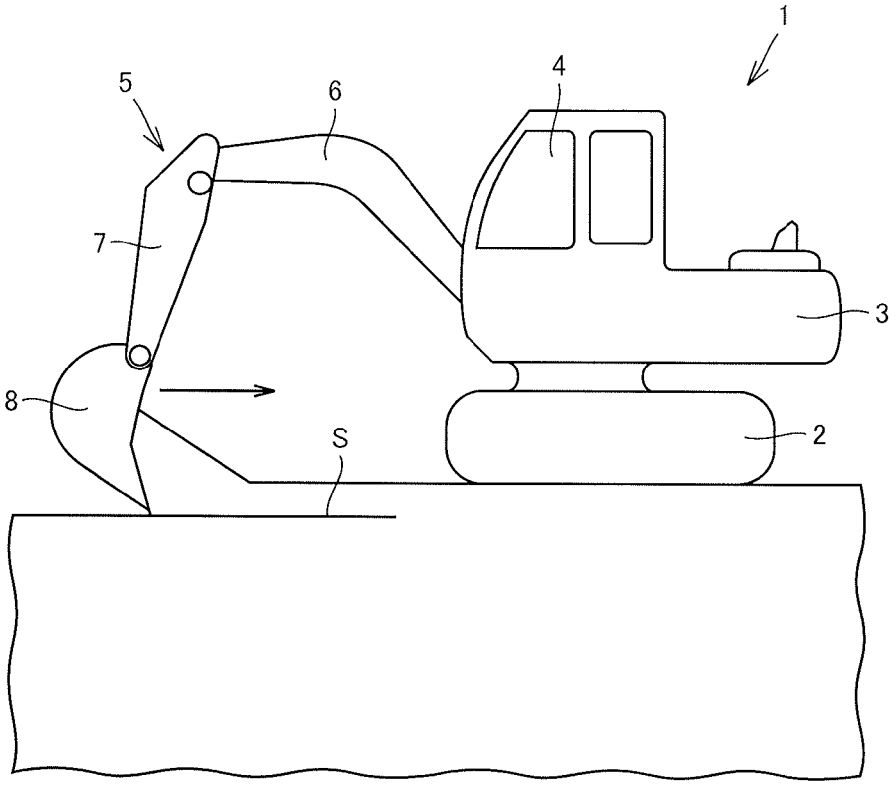
FIG. 7 is a schematic view of a land leveling work with the hydraulic excavator in accordance with an arm excavation operation.
Figure 12:
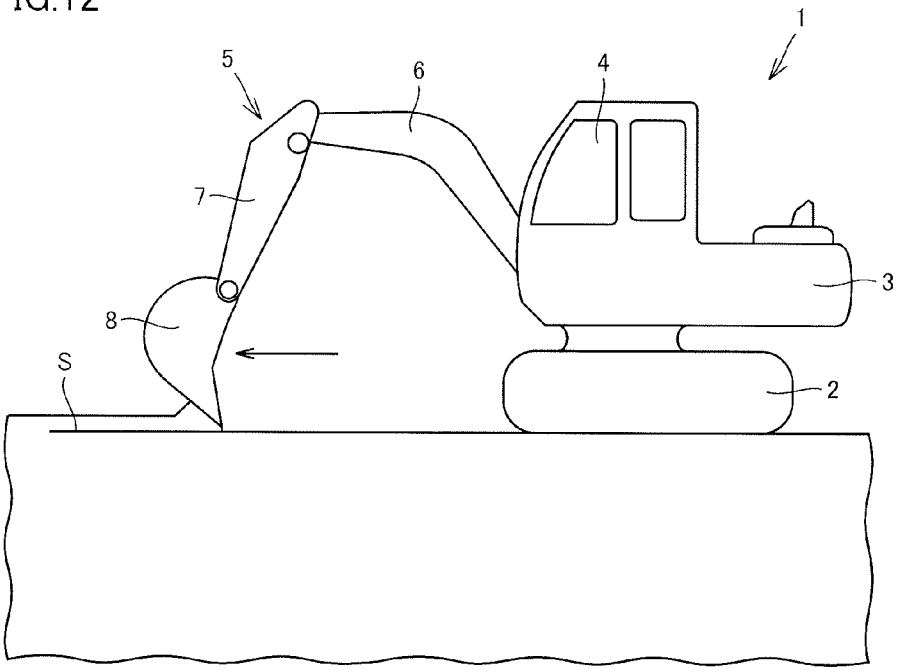
FIG. 12 is a schematic view of a land leveling work with the hydraulic excavator in accordance with an arm dump operation.

First, the land leveling work at the time of the arm excavation operation of operating arm 7 toward the excavation direction will be described. FIG. 7 is a schematic view of the land leveling work with hydraulic excavator 1 in accordance with the arm excavation operation. A design surface S shown in FIG. 7 and below-described FIG. 12 represents a target shape (design topography or target design topography) of a land to be leveled in accordance with the construction design data of a work object. The construction design data is prestored in controller 20 (FIG. 4). Controller 20 controls work implement 5 based on the construction design data and the current positional information of work implement 5. As shown by an arrow in FIG. 7, work implement 5 is operated such that arm 7 is moved toward the arm excavation direction and cutting edge 8*a* (refer to FIG. 1) of bucket 8 moves along design surface S, and thereby, the ground is leveled by cutting edge 8*a* of bucket 8 and land leveling into the design topography is performed.

Cutting edge 8*a* of bucket 8 moves to follow the arc-shaped path. Therefore, when design surface S is a flat surface, cutting edge 8*a* of bucket 8 may move away from the design surface if the operation for lowering boom 6 is not performed. Therefore, the operator operating work implement 5 operates second control lever 45 to perform the excavation operation by arm 7, and also continues to operate first control lever 44 toward the first pilot pressure control valve 41A side to perform the operation for lowering boom 6.

In the case where cutting edge 8*a* of bucket 8 moves to be lower than design surface S and excavates the ground excessively when work implement 5 is operated in accordance with the aforementioned operator's operation, an instruction for forcibly raising boom 6 is outputted from controller 20. When it is expected that cutting edge 8*a* of bucket 8 will move to be lower than design surface S, controller 20 executes control for automatically raising boom 6 to prevent the position of cutting edge 8*a* of bucket 8 from becoming lower than design surface S. At this time, controller 20 outputs instruction signal G3 for decreasing the opening degree of proportional solenoid valve 73 and instruction signal G5 for increasing the opening degree of proportional solenoid valve 75. As a result, proportional solenoid valve 73 that has been in the open state enters the fully-closed state, and proportional solenoid valve 75 that has been in the fully-closed state enters the open state.

When proportional solenoid valve 75 is opened, the discharge pressure on the exit side of third hydraulic pump 50 is applied to shuttle valve 80 via pump flow path 55. Shuttle valve 80 of higher pressure priority type operates to cause pump flow path 55 and first pilot port pb1 of pilot switching valve for the boom 37 to communicate with each other. As a result, the high-pressure pilot oil is supplied to first pilot port pb1 of pilot switching valve for the boom 37, and thus, the operation for raising boom 6 is performed.

In the case where cutting edge 8*a* of bucket 8 moves away from the ground when the operation for raising boom 6 is continued, forcible raising of boom 6 is stopped and an instruction for lowering boom 6 is outputted from controller 20 in accordance with the lowering operation of first control lever 44. At this time, controller 20 outputs instruction signal G3 for increasing the opening degree of proportional solenoid valve 73 and instruction signal G5 for decreasing the opening degree of proportional solenoid valve 75. As a result, proportional solenoid valve 73 that has been in the fully-closed state enters the open state, and proportional solenoid valve 75 that has been in the open state enters the fully-closed state.

When proportional solenoid valve 73 is opened, the pilot oil having a prescribed pilot pressure is supplied to second pilot port pb2 of pilot switching valve for the boom 37 via first pilot conduit 53, and thus, the operation for lowering boom 6 is performed.

First pilot conduit 53 has a function as a boom-lowering pilot conduit connected to second pilot port pb2 of pilot switching valve for the boom 37. Second pilot conduit 54 and pump flow path 55 have a function as a boom-raising pilot conduit connected to first pilot port pb1 of pilot switching valve for the boom 37 via shuttle valve 80. Proportional solenoid valve 73 provided in first pilot conduit 53 has a function as a boom-lowering proportional solenoid valve. Proportional solenoid valve 74 provided in second pilot conduit 54 has a function as a boom-raising proportional solenoid valve. Proportional solenoid valve 75 provided in pump flow path 55 has a function as a boom-raising proportional solenoid valve.

Both second pilot conduit 54 and pump flow path 55 have a function as a boom-raising pilot conduit. More specifically, second pilot conduit 54 functions as a normal boom-raising pilot conduit, and pump flow path 55 functions as a forcible boom-raising pilot conduit. In addition, proportional solenoid valve 74 can be expressed as a normal boom-raising proportional solenoid valve, and proportional solenoid valve 75 can be expressed as a forcible boom-raising proportional solenoid valve.

Hydraulic pressure sensor 63 detects the hydraulic pressure generated in first pilot conduit 53 between first pilot pressure control valve 41A and proportional solenoid valve 73 in accordance with the operation of first control lever 44. Based on the hydraulic pressure detected by hydraulic pressure sensor 63, controller 20 outputs instruction signal G3 to proportional solenoid valve 73 and controls the opening degree of proportional solenoid valve 73. Hydraulic pressure sensor 64 detects the hydraulic pressure generated in second pilot conduit 54 between second pilot pressure control valve 41B and proportional solenoid valve 74 in accordance with the operation of first control lever 44. Based on the hydraulic pressure detected by hydraulic pressure sensor 64, controller 20 outputs instruction signal G4 to proportional solenoid valve 74 and controls the opening degree of proportional solenoid valve 74. Controller 20 outputs instruction signal G5 to proportional solenoid valve 75 and controls the opening degree of proportional solenoid valve 75.

When the current position of cutting edge 8*a* of bucket 8 is compared with design surface S and cutting edge 8*a* is located at a position higher than design surface 5, control for lowering boom 6 is executed in accordance with the lowering operation of first control lever 44. When it becomes highly likely that cutting edge 8*a* invades design surface S, control for raising boom 6 is executed. Therefore, when the current position of cutting edge 8*a* of bucket 8 fluctuates with respect to design surface S, the setting of the opening degrees of proportional solenoid valve 73 and proportional solenoid valve 75 also changes frequently.

Figure 8:
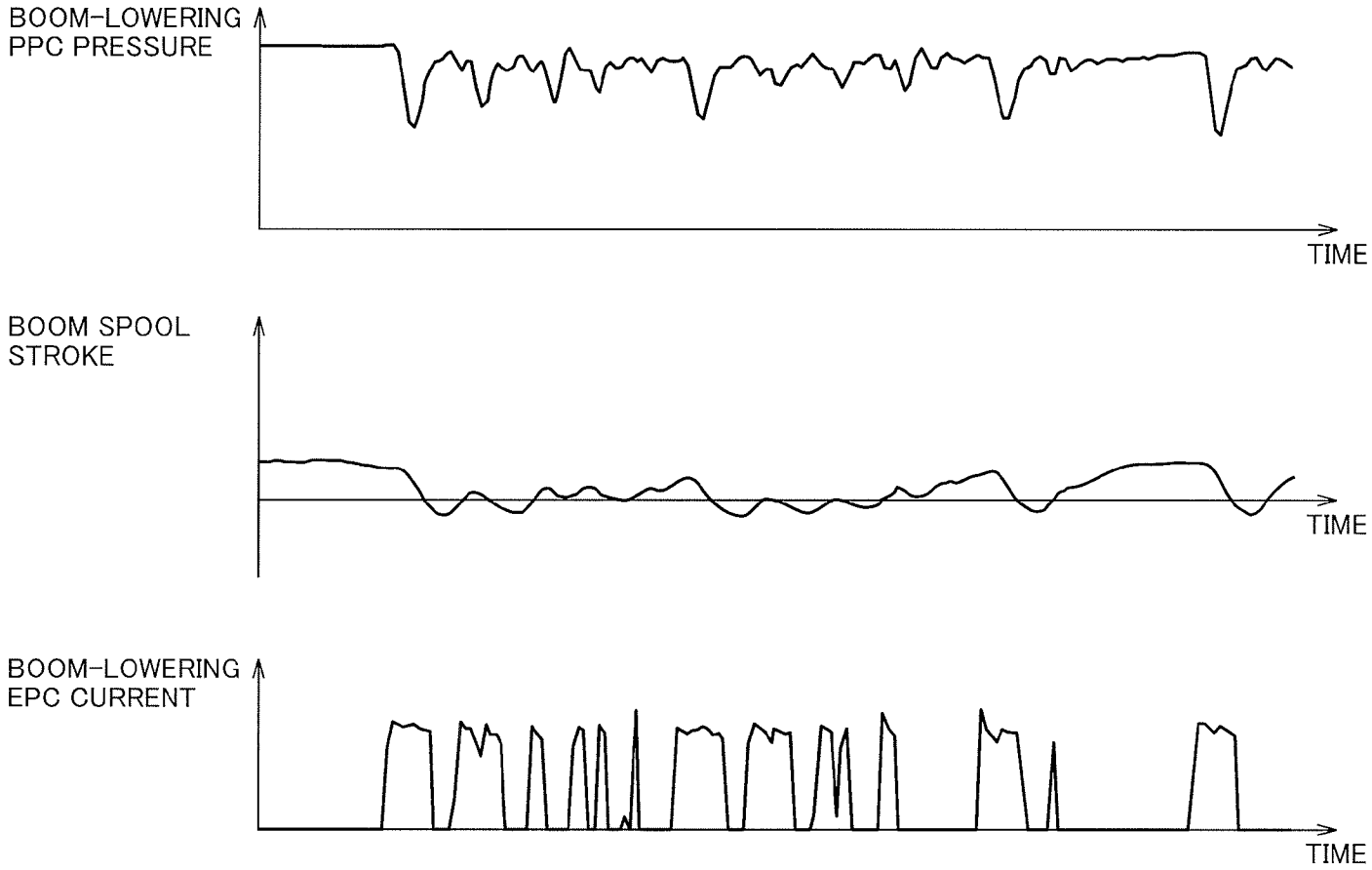
FIG. 8 is a graph showing a change in boom-lowering instruction current during the arm excavation operation in the hydraulic excavator before the present invention is applied.

FIG. 8 is a graph showing a change in boom-lowering instruction current during the arm excavation operation in the hydraulic excavator before the present invention is applied.

All of the horizontal axes of the three graphs in FIG. 8 represent the time. The vertical axis of the lower graph among the three graphs in FIG. 8 represents a current outputted to proportional solenoid valve 73 when controller 20 transmits instruction signal G3, which will be referred to as a boom-lowering EPC current. Each of proportional solenoid valve 73 and proportional solenoid valve 75 is a valve configured such that the opening degree thereof is zero (fully-closed) when the current value is zero, and the opening degree thereof continuously increases with an increase in current value.

The vertical axis of the middle graph in FIG. 8 represents the relative position of the spool when it is assumed that the neutral position of the spool of pilot switching valve for the boom 37 for operating boom cylinder 9 has a coordinate of zero, which will be referred to as a boom spool stroke. The vertical axis of the upper graph in FIG. 8 represents the hydraulic pressure in first pilot conduit 53 detected by hydraulic pressure sensor 63, which will be referred to as a boom-lowering PPC pressure.

A value of the boom-lowering EPC current shown in the lower graph in FIG. 8 increases sharply when the current value increases from zero, and thus, an inclination of the graph is steep. Similarly, the value decreases sharply when the current value decreases toward zero, and thus, an inclination of the graph is steep. Therefore, the opening degree of proportional solenoid valve 73 increases sharply upon receipt of the instruction for lowering boom 6, and decreases sharply upon receipt of the instruction for not lowering boom 6.

Since the opening degree of proportional solenoid valve 73 fluctuates sharply as described above, the pilot oil flows abruptly through first pilot conduit 53 from the first pilot pressure control valve 41A side to the pilot switching valve for the boom 37 side via proportional solenoid valve 73 when the opening degree of proportional solenoid valve 73 is increased from zero. In this case, if supply of the pilot oil to first pilot pressure control valve 41A via pump flow path 51 delays, the PPC pressure drops momentarily and the PPC pressure decreases sharply as shown in the upper graph in FIG. 8.

When the PPC pressure decreases, spool 85 and retainer 84 of first pilot pressure control valve 41A (refer to FIGS. 5 and 6) move relatively and spool 85 moves away from retainer 84. Thereafter, the pilot oil is supplementarily supplied from pump flow path 51 to first pilot pressure control valve 41A. When the PPC pressure increases, spool 85 and retainer 84 move to return to the original contact state, and spool 85 collides with retainer 84. Due to repetition of sharp increase and decrease in PPC pressure, the collision between spool 85 and retainer 84 occurs frequently and minute vibrations occur in first control lever 44, which brings a sense of discomfort to the operator operating first control lever 44.

Figure 9:
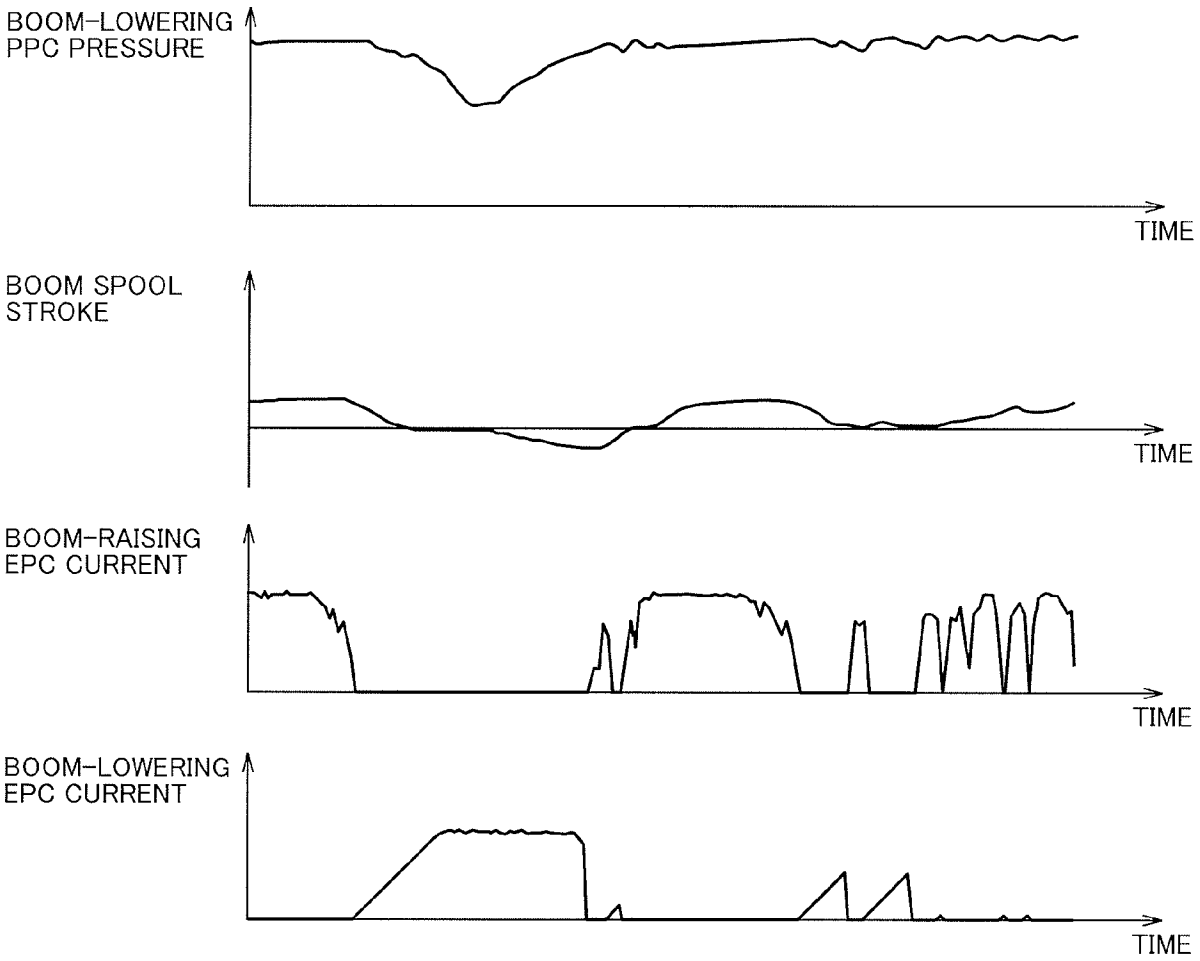
FIG. 9 is a graph showing a change in boom-lowering instruction current during the arm excavation operation in the hydraulic excavator according to the embodiment.

FIG. 9 is a graph showing a change in boom-lowering instruction current during the arm excavation operation in hydraulic excavator 1 according to the embodiment.

All of the horizontal axes of the four graphs in FIG. 9 represent the time. The vertical axis of the lowest graph among the four graphs in FIG. 9 represents the boom-lowering EPC current similar to that in FIG. 8. The vertical axis of the second lowest graph in FIG. 9 represents a current outputted to proportional solenoid valve 75 when controller 20 transmits instruction signal G5, which will be referred to as a boom-raising EPC current. The vertical axis of the second uppermost graph in FIG. 9 represents the boom spool stroke similar to that in FIG. 8. The vertical axis of the uppermost graph in FIG. 9 represents the boom-lowering PPC pressure similar to that in FIG. 8.

In hydraulic excavator 1 according to the present embodiment shown in FIG. 9, when boom 6 is lowered during the arm excavation operation, rising of the current value outputted to proportional solenoid valve 73 by controller 20 is gentle and the current value increases gently from zero. The lowest graph and the second lowest graph among the four graphs in FIG. 9 are compared. Then, an amount of increase in current per unit time when controller 20 outputs, to proportional solenoid valve 73, the instruction signal for instructing an increase in opening degree is smaller than an amount of increase in current per unit time when controller 20 outputs, to proportional solenoid valve 75, the instruction signal for instructing an increase in opening degree.

Figure 10:
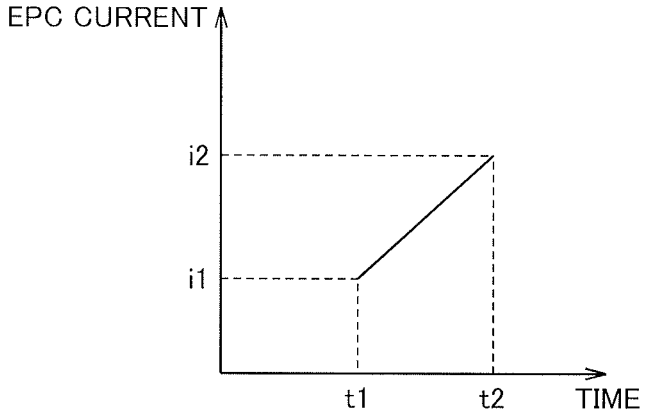
FIG. 10 is a graph showing an increase in current value when an opening degree of a proportional solenoid valve is increased.

The amount of increase in current per unit time will be described. FIG. 10 is a graph showing an increase in current value when the opening degree of the proportional solenoid valve is increased. As shown in FIG. 10, it is assumed that it represents a value of the EPC current outputted to the proportional solenoid valve at time t1, and i2 represents a value of the EPC current outputted to the proportional solenoid valve at time t2 later than time t1. When the relationship of i2>i1 is satisfied and the value of the EPC current at time t2 is larger than the value of the EPC current at time t1, the amount of increase in current per unit time has a value obtained by dividing the amount of increase in EPC current by the time from time t1 to time t2.

Based on the foregoing, the amount of increase in current per unit time is calculated in accordance with the following equation:

$$(\text{amount of increase in current per unit time})=(i2-i1)/(t2-t1).$$

Referring to the lowest graph among the four graphs in FIG. 9, in hydraulic excavator 1 according to the present embodiment shown in FIG. 9, during the arm excavation operation, the amount of increase in current per unit time when controller 20 outputs, to proportional solenoid valve 73, the instruction signal for instructing an increase in opening degree is smaller than an amount of decrease in current per unit time when controller 20 outputs, to proportional solenoid valve 73, an instruction signal for instructing a decrease in opening degree.

Figure 11:
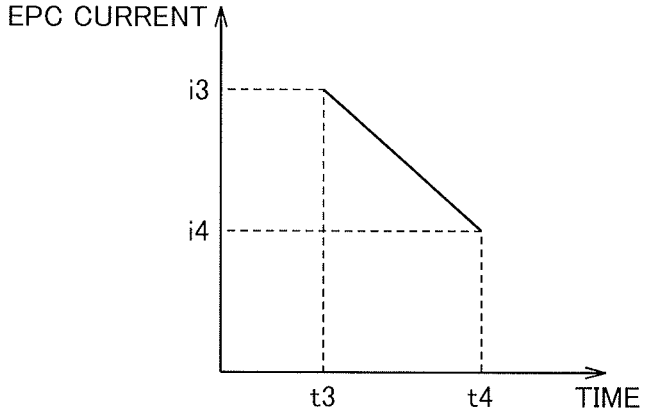
FIG. 11 is a graph showing a decrease in current value when the opening degree of the proportional solenoid valve is decreased.

The amount of decrease in current per unit time will be described. FIG. 11 is a graph showing a decrease in current value when the opening degree of the proportional solenoid valve is decreased. As shown in FIG. 11, it is assumed that i3 represents a value of the EPC current outputted to the proportional solenoid valve at time t3, and i4 represents a value of the EPC current outputted to the proportional solenoid valve at time t4 later than time t3. When the relationship of i3>i4 is satisfied and the value of the EPC current at time t4 is smaller than the value of the EPC current at time t3, the amount of decrease in current per unit time has a value obtained by dividing the amount of decrease in EPC current by the time from time t3 to time t4.

That is, the amount of decrease in current per unit time is calculated in accordance with the following equation:

$$(\text{amount of decrease in current per unit time})=(i3-i4)/(t4-t3).$$

Next, the land leveling work at the time of the arm dump operation of operating arm 7 toward the dump direction will be described. FIG. 12 is a schematic view of the land leveling work with hydraulic excavator 1 in accordance with the arm dump operation. As shown by an arrow in FIG. 12, work implement 5 is operated such that arm 7 is moved toward the arm dump direction and cutting edge 8a (refer to FIG. 1) of bucket 8 moves along design surface S, and thereby, the ground is leveled by cutting edge 8a of bucket 8 and land leveling into the design topography is performed.

The operator operating work implement 5 operates second control lever 45 to perform the dump operation by arm 7, and also continues to operate first control lever 44 toward the first pilot pressure control valve 41A side to perform the operation for lowering boom 6.

In the case where cutting edge 8a of bucket 8 moves to be lower than design surface S and excavates the ground excessively when work implement 5 is operated in accordance with the aforementioned operator's operation, an instruction for forcibly raising boom 6 is outputted from controller 20. When it is expected that cutting edge 8a of bucket 8 will move to be lower than design surface S, controller 20 executes control for automatically raising boom 6 to prevent cutting edge 8a of bucket 8 from becoming lower than design surface S.

In the case where cutting edge 8a of bucket 8 moves away from the ground when the operation for raising boom 6 is continued, forcible raising of boom 6 is stopped and an instruction for lowering boom 6 is outputted from controller 20 in accordance with the lowering operation of first control lever 44.

Similarly to the arm excavation operation, during the arm dump operation as well, when the current position of cutting edge 8a of bucket 8 is compared with design surface S and cutting edge 8a is located at a position higher than design surface S, control for lowering boom 6 is executed in accordance with the lowering operation of first control lever 44. When it becomes highly likely that cutting edge 8a invades design surface 5, control for raising boom 6 is executed.

Figure 13:
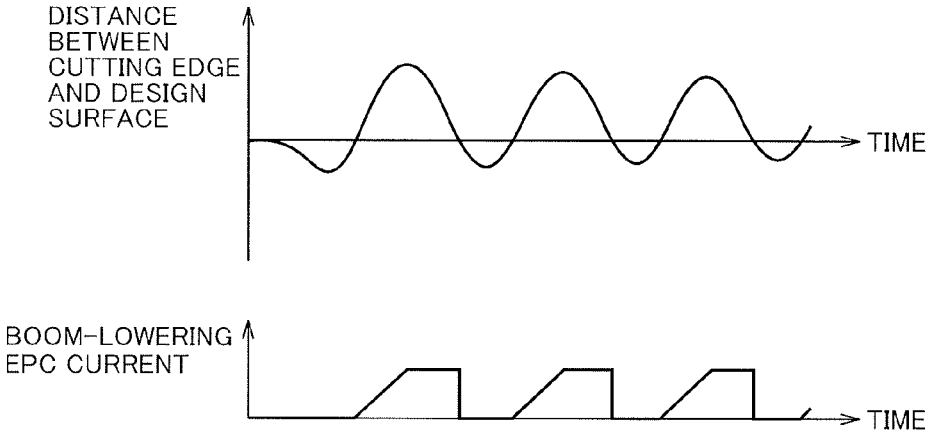
FIG. 13 is a graph showing a change in boom-lowering instruction current during the arm dump operation in the hydraulic excavator before the present invention is applied.

FIG. 13 is a graph showing a change in boom-lowering instruction current during the arm dump operation in the hydraulic excavator before the present invention is applied. All of the horizontal axes of the two graphs in FIG. 13 represent the time. The vertical axis of the lower graph in FIG. 13 represents the boom-lowering EPC current similar to that in FIG. 8. The vertical axis of the upper graph in FIG. 13 represents a distance between cutting edge 8a of bucket 8 and design surface S.

When cutting edge 8a of bucket 8 is located at a position higher than design surface S, control is executed such that boom 6 is lowered and cutting edge 8a moves along design surface S. Similarly to the value of the boom-lowering EPC current during the arm excavation operation shown in FIG. 9, the value of the boom-lowering EPC current shown in the lower graph in FIG. 13 increases gently from zero.

Proportional solenoid valve 73 is configured such that in the case of increasing the opening degree from the fully-closed state, the opening operation is started when the current value increases from zero to a prescribed threshold value. For example, proportional solenoid valve 73 may be configured such that the opening operation is started when the boom-lowering EPC current increases to 40% of the rated current. To proportional solenoid valve 73 having the aforementioned configuration, controller 20 outputs the gently increasing current value. As a result, the response speed of the operation for lowering boom 6 with respect to the operator's operation is low.

Therefore, it takes time from when the boom-lowering EPC current starts to increase to when boom 6 actually starts the lowering operation. As shown in the upper graph in FIG. 13, the time period during which cutting edge 8*a* of bucket 8 is located at the position higher than design surface S becomes longer. This results in hunting in which cutting edge 8*a* vibrates vertically with respect to design surface S, and thus, it requires a long time to settle cutting edge 8*a* on design surface S.

Figure 14:
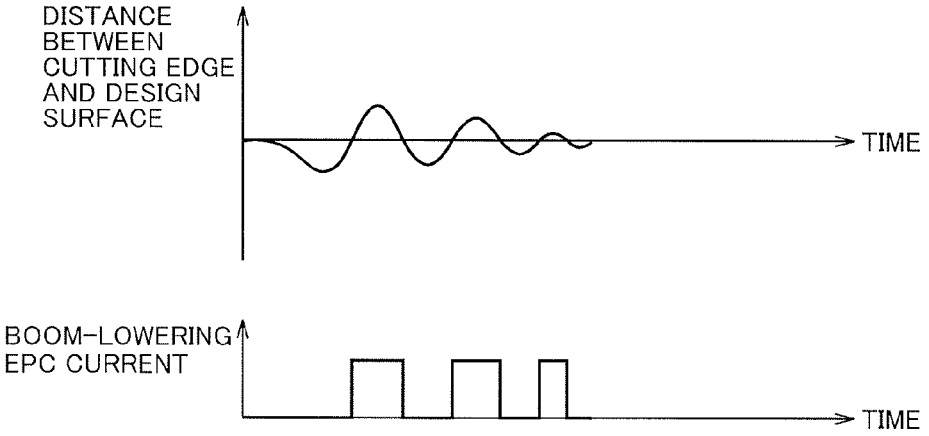
FIG. 14 is a graph showing a change in boom-lowering instruction current during the arm dump operation in the hydraulic excavator according to the present embodiment.

Hydraulic excavator 1 according to the present embodiment has been made to solve this phenomenon. FIG. 14 is a graph showing a change in boom-lowering instruction current during the arm dump operation in hydraulic excavator 1 according to the present embodiment. All of the horizontal axes of the two graphs in FIG. 14 represent the time. The vertical axis of the lower graph in FIG. 14 represents the boom-lowering EPC current similar to that in FIG. 13. The vertical axis of the upper graph in FIG. 14 represents the distance between cutting edge 8*a* of bucket 8 and design surface S similar to that in FIG. 13.

As shown in the lower graph in FIG. 14, in hydraulic excavator 1 according to the present embodiment, controller 20 sharply increases the current value outputted to proportional solenoid valve 73 in a step function manner during the arm dump operation. The value of the boom-lowering EPC current shown in the lower graph in FIG. 14 increases sharply when the current value increases from zero, and thus, an inclination of the graph is steep. Upon receipt of the instruction for lowering boom 6, proportional solenoid valve 73 increases the opening degree sharply.

The lower graph in FIG. 13 and the lower graph in FIG. 14 are compared. Then, in hydraulic excavator 1 according to the present embodiment shown in FIG. 14, when boom 6 is lowered during the arm dump operation, rising of the current value outputted to proportional solenoid valve 73 by controller 20 is steep and the current value increases rapidly from zero. In hydraulic excavator 1 according to the present embodiment, the amount of increase in current per unit time when controller 20 outputs, to proportional solenoid valve 73, the instruction signal for instructing an increase in opening degree is larger during the arm dump operation than during the arm excavation operation.

Next, the function and effect of the present embodiment will be described.

According to the present embodiment, as shown in FIG. 9, when boom 6 is lowered during the arm excavation operation, the current value outputted to proportional solenoid valve 73 by controller 20 increases gently from zero. The boom-lowering EPC current shown in FIG. 9 does not increase sharply in a step function manner but increases gradually with the passage of time. The boom-lowering EPC current increases to have a gradient with respect to the time. Controller 20 executes control for temporally delaying the increase in boom-lowering EPC current and outputting the boom-lowering EPC current such that the opening degree of proportional solenoid valve 73 increases smoothly with respect to the passage of time when the opening degree of proportional solenoid valve 73 is increased.

The graph before the present invention is applied as shown in FIG. 8 and the graph in the present embodiment shown in FIG. 9 are compared. Then, the time that elapses before the current value increases from zero and reaches the same value is longer in the present embodiment. By reducing an amplification factor when the boom-lowering EPC current is increased and relatively reducing a rate of increase in current when proportional solenoid valve 73 is opened, the sensitivity of proportional solenoid valve 73 decreases and the valve opening speed of proportional solenoid valve 73 decreases.

By reducing the valve opening speed when proportional solenoid valve 73 is opened, abrupt flow of the pilot oil to the pilot switching valve for the boom 37 side via proportional solenoid valve 73 can be suppressed. Therefore, sharp decrease in amount of the pilot oil present in first pilot conduit 53 between first pilot pressure control valve 41A that constitutes first control lever device 41 and proportional solenoid valve 73 can be suppressed. As a result, fluctuations in pressure of the pilot oil between first pilot pressure control valve 41A and proportional solenoid valve 73 can be suppressed, and thus, the frequency of increase and decrease in PPC pressure is low as shown in the uppermost graph in FIG. 9.

In the upper graph in FIG. 8, the decrease in PPC pressure occurs frequently and collision between spool 85 and retainer 84 of first pilot pressure control valve 41A occurs whenever the decrease in PPC pressure occurs, which causes minute vibrations in first control lever 44. In contrast, in the uppermost graph in FIG. 9, the decrease in PPC pressure occurs only once. That is, in hydraulic excavator 1 according to the present embodiment, frequent occurrence of the decrease in PPC pressure is prevented, and thus, the frequency of the collision between spool 85 and retainer 84 of first pilot pressure control valve 41A is low.

Therefore, in hydraulic excavator 1 according to the present embodiment, occurrence of minute vibrations in first control lever 44 can be suppressed, and thus, occurrence of chattering that brings a sense of discomfort to the operator can be avoided.

If the rate of increase in current when the opening degree of proportional solenoid valve 73 is increased is reduced excessively, the responsiveness to the operator's operation decreases. That is, it takes time from when the operator performs the operation of first control lever 44 to when boom 6 operates, and the operator may feel that the operation of boom 6 is slow and may feel stress. Therefore, it is desirable to reduce the rate of increase in current when the opening degree of proportional solenoid valve 73 is increased, so as not to affect the responsiveness of the operation of work implement 5 at the time of manual operation. For example, the rate of increase in current when the opening degree of proportional solenoid valve 73 is increased may be set to fall within 1/100 times or more and 1/2 times or less of a rate of increase in current when the opening degree of proportional solenoid valve 75 is increased.

On the other hand, as shown in FIG. 14, when boom 6 is lowered during the arm dump operation, the current value outputted to proportional solenoid valve 73 by controller 20 increases more sharply than during the arm excavation operation. An inclination when the boom-lowering EPC current increases from zero as shown in FIG. 14 is steeper than an inclination of the boom-lowering EPC current shown in FIG. 9.

The boom-lowering EPC current during the arm excavation operation shown in FIG. 9 and the boom-lowering EPC current during the arm dump operation shown in FIG. 14 are compared. Then, the time that elapses before the current value increases from zero and reaches the same value is shorter during the arm dump operation. By increasing the amplification factor when the boom-lowering EPC current is increased and relatively increasing the rate of increase in current when proportional solenoid valve 73 is opened, during the arm dump operation, the sensitivity of proportional solenoid valve 73 increases and the valve opening speed of proportional solenoid valve 73 increases.

By increasing the valve opening speed when proportional solenoid valve 73 is opened during the arm dump operation, control becomes possible for lowering boom 6 quickly and bringing cutting edge 8*a* close to design surface S in a short time when cutting edge 8*a* of bucket 8 is located above design surface S. When cutting edge 8*a* of bucket 8 is located at a position distant from the design surface, boom 6 is quickly raised or lowered, such that cutting edge 8*a* can be fitted to design surface S promptly. Therefore, cutting edge 8*a* of bucket 8 can be moved along design surface S in a stable manner, and thus, occurrence of hunting can be suppressed and the highly-accurate land leveling work can be performed.

In addition, as shown in FIGS. 9 and 14, the amount of increase in current per unit time when controller 20 outputs, to proportional solenoid valve 73, the instruction signal for instructing an increase in opening degree is larger during the arm dump operation than during the arm excavation operation. Comparing when the current value outputted to proportional solenoid valve 73 increases during the arm excavation operation and when the current value outputted to proportional solenoid valve 73 increases during the arm dump operation, the time required to change by the same current value is shorter during the arm dump operation. A rate of increase per unit time in opening degree of proportional solenoid valve 73 during the arm dump operation is larger than a rate of increase per unit time in opening degree of proportional solenoid valve 73 during the arm excavation operation.

By relatively increasing the valve opening speed of proportional solenoid valve 73 during the arm dump operation, boom 6 can be lowered more quickly. Therefore, it becomes possible to bring cutting edge 8*a* of bucket 8 close to design surface S more quickly and move cutting edge 8*a* along design surface S when cutting edge 8*a* of bucket 8 is located at an upper position with respect to design surface S. Therefore, the efficiency and quality during the work for leveling the ground with hydraulic excavator 1 can be enhanced.

In addition, as shown in FIG. 14, during the arm excavation operation, controller 20 increases, in a step manner, the current value outputted to proportional solenoid valve 73. By further increasing an inclination angle of rising of the boom-lowering EPC current, the amount of increase per unit time in boom-lowering EPC current increases further and boom 6 can be lowered more quickly. Therefore, boom 6 is quickly lowered, such that cutting edge 8*a* can be fitted to design surface S promptly, and thus, the highly-accurate land leveling work can be performed.

It should be understood that the embodiment disclosed herein is illustrative and not limitative in any respect. The scope of the present invention is defined by the terms of the claims, rather than the description above, and is intended to include any modifications within the scope and meaning equivalent to the terms of the claims.

REFERENCE SIGNS LIST

1 hydraulic excavator; 2 carriage; 3 revolving unit; 4 cab; 5 work implement; 6 boom; 7 arm; 8 bucket; 8*a* cutting edge; 9 boom cylinder; 20 controller; 34 main operation valve; 35 tank; 36 pilot switching valve for the arm; 37 pilot switching valve for the boom; 41 first control lever device; 41A to 41D, 42A to 42D pilot pressure control valve; 42 second control lever device; 44 first control lever; 45 second control lever; 50 third hydraulic pump; 51, 55 pump flow path; 52 tank flow path; 53, 54, 56 to 61 pilot conduit; 63, 64, 66 to 69 hydraulic pressure sensor; 70 relay block; 73 to 79 proportional solenoid valve; 80 shuttle valve; 81 valve main body; 82 cylinder portion; 83 piston; 84 retainer; 85 spool; 86 main spring; 87 spring; G3 to G9 instruction signal; P3, P4, P6 to P9 pressure signal; S design surface; pa1, pb1, pbk1 first pilot port; pa2, pb2, pbk2 second pilot port.

The invention claimed is:

1. A hydraulic excavator, comprising:

a work implement including a boom and an arm attached to said boom;

a pilot switching valve for said boom including a boom-lowering pilot port and controlling operation of said boom;

a boom-lowering pilot conduit connected to said boom-lowering pilot port;

a boom-lowering proportional solenoid valve provided in said boom-lowering pilot conduit;

an operation member for accepting user operation of driving said work implement and outputting a hydraulic pressure signal corresponding to said user operation; and a controller for controlling an opening degree of said boom-lowering proportional solenoid valve, when an arm dump signal for performing dump operation of said arm is included in said hydraulic pressure signal, said controller sharply increasing a current value outputted to said boom-lowering proportional solenoid valve, as compared with when said controller outputs a current value to said boom-lowering proportional solenoid valve when an arm excavation signal for performing excavation operation of said arm is included in said hydraulic pressure signal.

2. The hydraulic excavator according to claim 1, wherein an amount of increase in current per unit time when said controller outputs, to said boom-lowering proportional solenoid valve, an instruction signal for instructing an increase in opening degree is larger when said arm dump signal is included in said hydraulic pressure signal than when said arm excavation signal is included in said hydraulic pressure signal.

3. The hydraulic excavator according to claim 1, wherein when said arm dump signal is included in said hydraulic pressure signal, said controller increases, in a step manner, the current value outputted to said boom-lowering proportional solenoid valve.

4. The hydraulic excavator according to claim 1, wherein said work implement further includes a bucket attached to said arm and having a cutting edge, and said controller controls said boom to prevent said cutting edge from becoming lower than a design topography indicating a target shape of a work object.

5. The hydraulic excavator according to claim 1, wherein said controller transmits and receives information by satellite communication.

6. The hydraulic excavator according to claim 2, wherein when said arm dump signal is included in said hydraulic pressure signal, said controller increases, in a step manner, the current value outputted to said boom-lowering proportional solenoid valve.

7. The hydraulic excavator according to claim 2, wherein said work implement further includes a bucket attached to said arm and having a cutting edge, and said controller controls said boom to prevent said cutting edge from becoming lower than a design topography indicating a target shape of a work object.

8. The hydraulic excavator according to claim 2, wherein said controller transmits and receives information to and from the outside by satellite communication.

* * * * *